US010056718B2

(12) United States Patent
Dang et al.

(10) Patent No.: US 10,056,718 B2
(45) Date of Patent: Aug. 21, 2018

(54) ELECTRICAL CONNECTOR AND MODULES FOR HIGH-SPEED CONNECTIVITY

(71) Applicant: PIC Wire & Cable, Inc., Sussex, WI (US)

(72) Inventors: Phong Dang, Auburn, WA (US); Phong Thao, Milwaukee, WI (US)

(73) Assignee: PIC Wire & Cable, Inc., Sussex, WI (US)

( * ) Notice: Subject to any disclaimer, the term of this patent is extended or adjusted under 35 U.S.C. 154(b) by 0 days.

(21) Appl. No.: 15/654,483

(22) Filed: Jul. 19, 2017

(65) Prior Publication Data

US 2018/0026403 A1 Jan. 25, 2018

Related U.S. Application Data

(60) Provisional application No. 62/364,658, filed on Jul. 20, 2016.

(51) Int. Cl.
*H01R 4/38* (2006.01)
*H01R 13/6596* (2011.01)
(Continued)

(52) U.S. Cl.
CPC ..... *H01R 13/6596* (2013.01); *H01R 13/434* (2013.01); *H01R 13/5841* (2013.01);
(Continued)

(58) Field of Classification Search
CPC ..... H01R 13/6596; H01R 13/6592; H01R 13/6599; H01R 13/6571; H01R 13/6463;
(Continued)

(56) References Cited

U.S. PATENT DOCUMENTS 7,601,029 B2 * 10/2009 Horiuchi ..... H01R 4/20 439/497
9,172,149 B2 * 10/2015 Xing ..... H01R 9/035
(Continued)

FOREIGN PATENT DOCUMENTS

JP 2011-253807 12/2011

OTHER PUBLICATIONS

International Search Report and Written Opinion for PCT/US2017/042890 dated Oct. 27, 2017, 12 pages.

*Primary Examiner* — Jean F Duverne
(74) *Attorney, Agent, or Firm* — Reinhart Boerner Van Deuren S.C.

(57) ABSTRACT

A connector system having a plurality of high-speed connector modules, an anti-decoupling connector shell, and a multi axis backshell is provided. The high-speed module provides a low signal degradation electrically conductive signal path for terminated wires of twisted pairs of wires. The high-speed module additionally provides for dense placement of the terminated wires within the connector shell. The connector shell provides an anti-decoupling mechanism to prevent decoupling of the connector shell from a socket type connector shell resulting from typical forces applied to the connector shell. The multi-axis backshell provides mechanisms to toollessly adjust the angle of the various components making up the backshell which in turn provides a specifically angled path for cables contained within the backshell.

12 Claims, 20 Drawing Sheets

(51) Int. Cl.

| | |
|---|---|
| ***H01R 13/6463*** | (2011.01) |
| ***H01R 13/58*** | (2006.01) |
| ***H01R 13/6592*** | (2011.01) |
| ***H01R 13/6589*** | (2011.01) |
| ***H01R 13/434*** | (2006.01) |
| ***H01R 13/623*** | (2006.01) |

(52) U.S. Cl.
CPC ..... *H01R 13/623* (2013.01); *H01R 13/6463* (2013.01); *H01R 13/6589* (2013.01); *H01R 13/6592* (2013.01)

(58) Field of Classification Search
CPC ..... H01R 13/623; H01R 13/434; H01R 13/6589; H01R 13/5841; H01R 9/035; H01R 9/034; H01R 4/20
USPC ..... 439/321
See application file for complete search history.

(56) References Cited

U.S. PATENT DOCUMENTS

| | | | | |
|---|---|---|---|---|
| 9,627,819 | B2 * | 4/2017 | Post | H01R 13/6599 |
| 2003/0096529 | A1 | 5/2003 | Brennen et al. | |
| 2004/0038564 | A1 * | 2/2004 | Yan | H01R 13/6471 439/76.1 |
| 2009/0197467 | A1 * | 8/2009 | Ko | H01R 9/034 439/607.28 |
| 2014/0017926 | A1 | 1/2014 | Wu et al. | |
| 2014/0065884 | A1 | 3/2014 | Wu et al. | |
| 2014/0120769 | A1 | 5/2014 | Dang | |

* cited by examiner

ELECTRICAL CONNECTOR AND MODULES FOR HIGH-SPEED CONNECTIVITY

CROSS-REFERENCE TO RELATED APPLICATIONS

This patent application claims the benefit of U.S. Provisional Patent Application No. 62/364,658, filed Jul. 20, 2016, the entire teachings and disclosure of which are incorporated herein by reference thereto.

BACKGROUND OF THE INVENTION

The present invention relates generally to the field of electrical connectors. The present invention relates specifically to an electrical connector and modules for high-speed connectivity. High-speed data transmission is required for accurately and quickly transmitting the large amount of data common in today's telecommunications applications. One common medium for high-speed situations is fiber optics. Fiber optic cables transmit signal in the form of light through reinforced glass cables. Fiber optic transmission has several advantages over traditional wire cables. Specifically, fiber optic cables are more redundant against interferences and produce very minimal signal degradation over long cable runs. However, fiber optic cables are expensive and are less physically robust than traditional wire cables because they are made of glass. This limits the flexibility of fiber optic cables and often precludes their use in applications requiring high levels of redundancy, flexibility, and reliability.

In such applications, wire cables specially engineered to reduce noise and signal degradation are used. These cables group together individual wires into sets of twisted pairs. The twisted pair wire configuration allows each individual wire to offset the noise form the counterpart wire it is twisted with. This solution is greatly effective at increasing the speed capabilities of standard metal wires. However, the termination and connector points of the wires are generally inefficient resulting in large increases in noise and signal degradation relative to those of the wires themselves. Connector points allow for proper termination of the wires at devices and for the branching out of sets of wires for flexibility in layout arrangements. Current solutions to this problem suffer from two identifiable problems. First, the existing solutions provide a modest improvement in efficiency but are not capable of fully maximizing the transfer efficiency of the wires themselves. Second, the existing solutions have maxed out the amount of wires that can be placed in a single standard connector. What is needed is a connector system that imports less noise, has less signal degradation, and has increased wire density when placed in a single standard connector.

Some of the current connector systems also have limitations unrelated to the electrical performance characteristics. Specifically, the robust high-speed connectors are often deployed in military applications where a standard D38999 type or similar circular connector is required. These connectors are designed so that the electrical connectors are supported within a housing which is surrounded by a ring having either male or female threads. The ring with the female threads is screwed into a connector having male threads and the electrical connectors are likewise joined. However, in particular stress situations the threaded connector can become loosened and eventual will decouple causing the electrical connectors to decouple and thus may cause failure to a vital system. What is needed is a connector that will not loosen with stress but will still conform to the standards for connectors that are often used in relation to high-speed electrical data transfer systems.

Some of the current connector systems use a backshell to protect and direct cables into and out of the connectors. Often these backshells have an adjustable angle so that the same connector can be used regardless of the direction called for in the plan layout. However, the adjustable element is often secured using screws, bolts, or similar mechanisms that require use of a tool to change the angle. This feature prevents easy adjustment of the angle during installation to account for unforeseen issues. It also may limit dynamic access to the cables during repair operations. What is need is an adjustable angle backshell having a mechanism to adjust the angle without use of a tool that also remains securely locked when required.

SUMMARY OF THE INVENTION

One embodiment of the invention relates to a connector module including a one piece electrically conductive isolator. The one piece electrically conductive isolator includes a cavity to receive a cable containing a plurality of twisted pairs of wires. The one piece electrically conductive isolator also includes a forward section having a plurality of channels equal in number to the plurality of twisted pairs of wires. Each channel has at least one horizontal wall and at least one vertical wall. The one piece electrically conductive isolator also includes a junction between the cavity and the forward section where each twisted pair of the plurality of twisted pairs of wires is separated into a different channel of the forward section. The connector module also includes a first insulating member having a plurality of indentations. The first insulating member is coupled to at least a portion of the horizontal and vertical walls of the channels. The connector module also includes a plurality of electrical contacts situated in the indentations of the first insulating member. The electrical contacts are electrically coupled to an end of each wire in each twisted pair of the plurality of twisted pairs. The connector module also includes a second insulating member surrounding the first insulating member and the conductors.

Another embodiment of the invention relates to a decoupling resistive connector shell. The connector shell includes a coupling nut having a first engagement structure and a second engagement structure. The connector shell also includes a top insert coupled to the coupling nut. The top insert has a plurality of channels. The connector shell also includes a bottom insert coupled to the top insert. The bottom insert has a locking flange and a plurality of channels aligned with the plurality of channels of the top insert. The connector shell also includes an anti-decoupling ring disposed around a portion of the top and bottom inserts. The anti-decoupling ring is engaged with the second engagement structure of the coupling nut, and has a notch to engage with the locking flange of the bottom insert to resist rotation of the anti-decoupling ring around the top and bottom inserts. The resisted rotation of the anti-decoupling ring in turn prevents rotation of the coupling nut through the engagement with the second engagement structure.

Another embodiment of the invention relates to a multiple axis backshell for tool-less reconfiguration. The backshell includes a forward member having an engagement structure for selectively coupling the backshell to a connector shell and a first pivot structure. The backshell also includes a reward member having a cavity for receiving a plurality of cables and a second pivot structure. The backshell also includes an engageable attachment mechanism. The attachment mechanism couples the first pivot to the second pivot such that when the attachment mechanism is engaged the reward member can freely rotate around the forward member and when the attachment mechanism is disengaged the reward member is fixed at a specific angle relative to the forward member.

Another embodiment of the invention relates to a connector module. The connector module includes a one piece metal connector support. The one piece metal connector support includes a cavity to receive a sheath containing a plurality of twisted pairs of wires. The one piece metal connector support also includes a forward section having a plurality of channels equal in number to the plurality of twisted pairs of wires. Each channel has a pair of walls joined at substantially a right angle. The one piece metal connector support also includes a junction between the cavity and the forward section. The sheath terminates at the junction. The connector module also includes a sleeve formed from electrically insulating material to provide a pair of insulated channels laying within each channel of the forward section. The connector module also includes a plurality of electrical contacts each positioned in a respective insulated channel. The contacts electrically coupled to an end of each wire in each twisted pair of the plurality of twisted pairs. The sleeve electrically isolates the contacts from each other and the metal connector support. The connector module also includes a cover formed from electrically insulating material. The cover surrounds the sleeve, contacts and the forward section.

Another embodiment of the invention relates to a connector shell. The connector shell including a first connector module sized to contain a plurality of cables. The first connector module provides a separate electrically conductive path for individual wires contained within the first plurality of cables. The connector shell also includes a second connector module sized to contain a second plurality of cables different in number to that of the first connector. The second connector provides a separate electrically conductive path for individual wires contained within the second plurality of cables. The connector shell also includes a housing having conduits sized and shaped to contain the first and second connector modules. The housing provides a grounding path for noise and interference form the first and second connector modules.

Alternative exemplary embodiments relate to other features and combinations of features as may be generally recited in the claims.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION

Referring generally to the figures, various embodiments of connector modules, connector shells to hold the connector modules, and backshells to maintain and arrange cables threaded through the connector modules are shown and described. The various embodiments of high-speed modules allow for increased speed over existing solutions and greater density of connectors within existing standard connector shell configurations. Specifically, the various embodiments provide for data speeds of 10 Gbit/s or greater.

Figure 1:
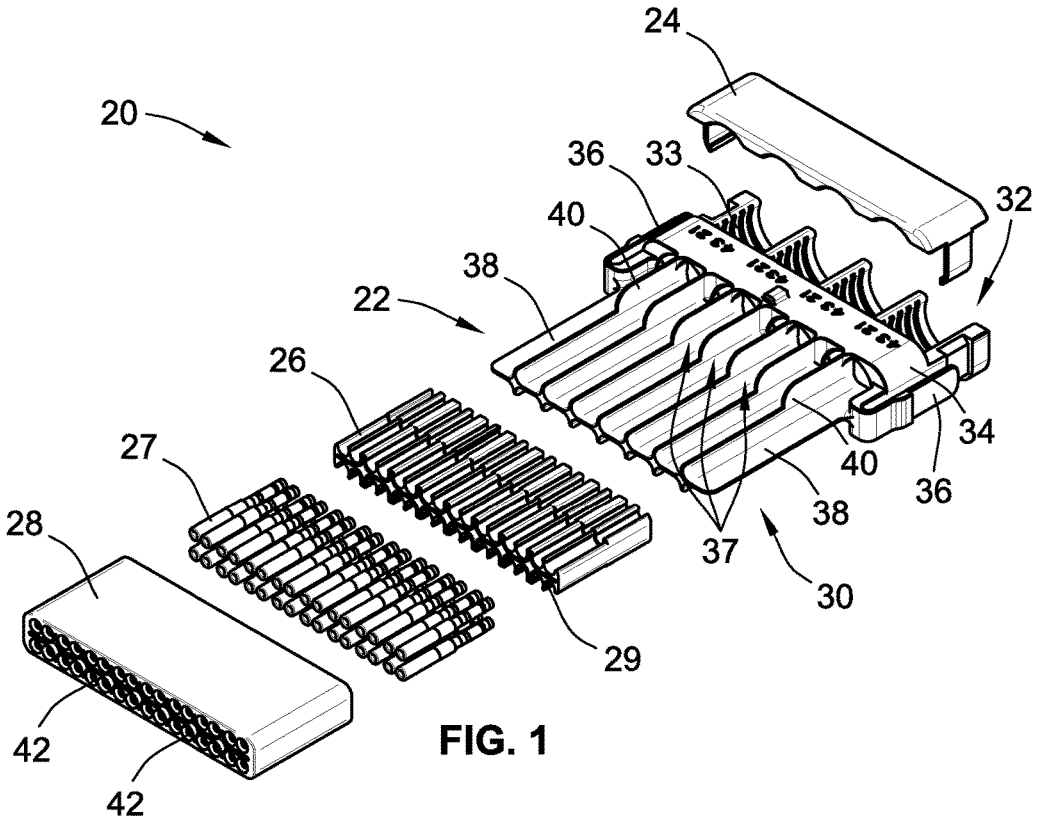
FIG. 1 is a perspective exploded view of the components of an example female connector module according to one embodiment.

Referring to FIG. 1, an example embodiment of a connector module 20 is shown. Connector module 20 includes a one piece electrically conductive isolator (i.e. metal connector, plug contact, separator, etc.) 22, a top isolator (i.e. grounding isolator, strain relief isolator, support, etc.) 24, a first insulating member (i.e. inner insulator, sleeve, etc.) 26, a plurality of electrical or plug contacts 27, and a second insulating member (i.e. cover, outer insulator, etc.) 28. Electrically conductive isolator 22 is preferably manufactured (machined, cast, etc.) from a single electrically conductive material. In one embodiment, the electrically conductive material is metal such as 7075 Aluminum, Beryllium C171/172, equivalent copper electroless, or cadmium plating.

Figure 5:
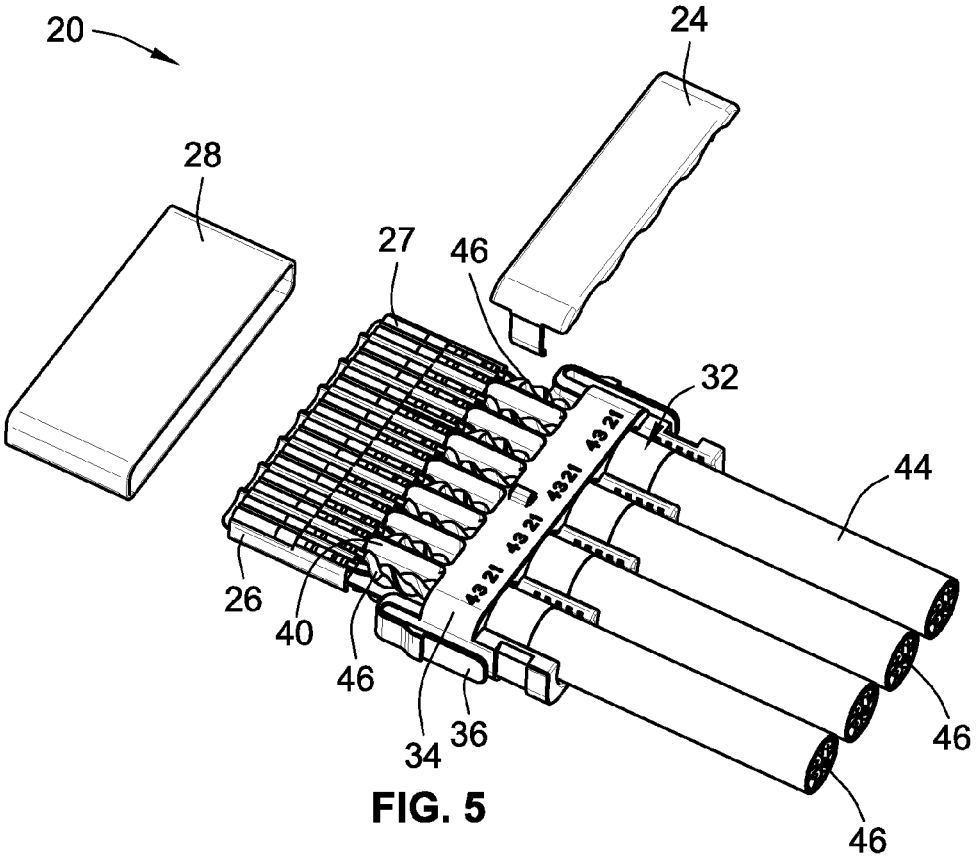
FIG. 5 is a perspective view of the module of FIG. 1 including cables and wires.
Figure 6:
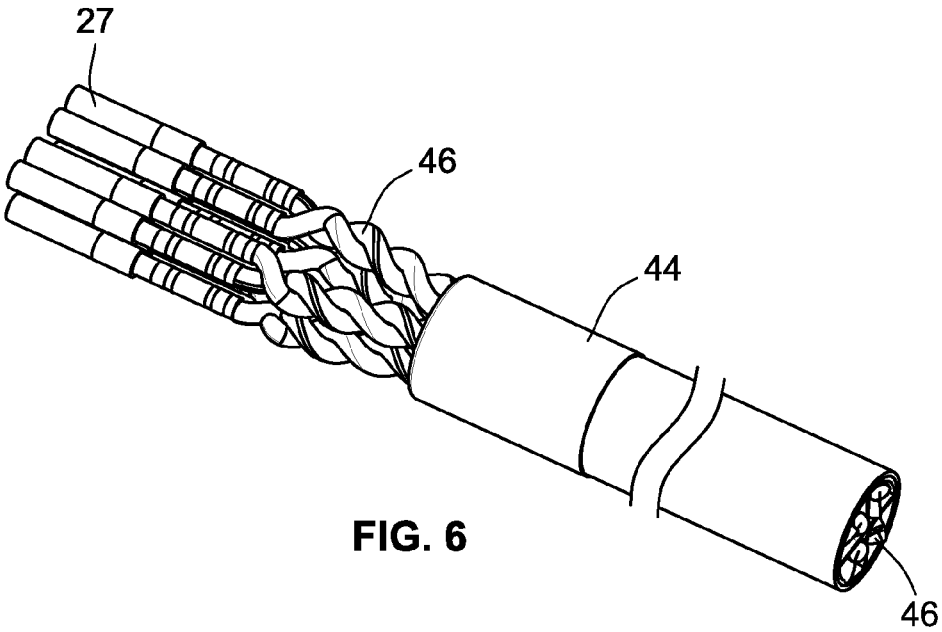
FIG. 6 is a perspective view of an example cable having 4 sets of twisted pair wires.

Isolator 22 includes a forward section 30, at least one cavity 32, a junction 34 between forward section 30 and cavity 32, and coupling members or tangs 36. Forward section 30 includes a plurality of channels 37, each channel having at least a one horizontal wall 38 and one vertical wall or fin 40 joined at substantially a right angle. Cavity 32 is designed to retain a cable or sheath 44 (see FIG. 5 and FIG. 6) within isolator 22. Groves 33 may be formed in cavity 32 to provide additional retaining or strain relief strength. Cavity 32 includes an exposed upper section. In other embodiments, the at least one cavity 32 may be provided in a bottom bracket component which may be removably coupled to isolator 22. Tangs 36 are designed to couple the assembled connector module 20 into a connector shell or housing. The operation of tangs 36 is discussed in more detail below in reference to FIGS. 9-12.

Top isolator 24 is removably coupled over the exposed upper portion of cavity 32 to provide strain relief for the cable and 360 degree surface contact with the cable. Together cavity 32 and top isolator 24 provide a shield for cables 44. Top isolator 24 may be made of the same material as isolator 22. Top Isolator 24 shields the main isolator to reduce DC electrical resistance. In one embodiment, top isolator 24 is a toolless design that can be latched/retained in place and removed by pulling outward the 2 tangs used to couple it to isolator 22. In an alternative embodiment, top isolator 24 is integrally formed with isolator 22.

First insulating member 26 includes a plurality of indentations or grooves 29 for receiving and restraining the plurality of electrical contacts 27. First insulating member 26 is composed of an insulating material such a ULTEM or an equivalent thermoplastic material. Indentations 29 retain contacts 27 without the need for a special tool. First insulating member 26 provides an insulating barrier between contacts 27 and isolator 22. This barrier allows wire twisting formations close to contacts 27 (see FIGS. 5-8) and provides a proper dielectric property-impedance controlled/matched. In one embodiment, first insulating member 26 provides for a dielectric constant in the range of 3.2-3 and an impedance value approaching the designed impedance of cables 44. In one embodiment, the impedance value is between 110 and 90 ohms. The impedance value is a function of the distance between contacts 27, the diameter of contacts 27, and the dielectric properties of first insulating member 26.

Figure 2:
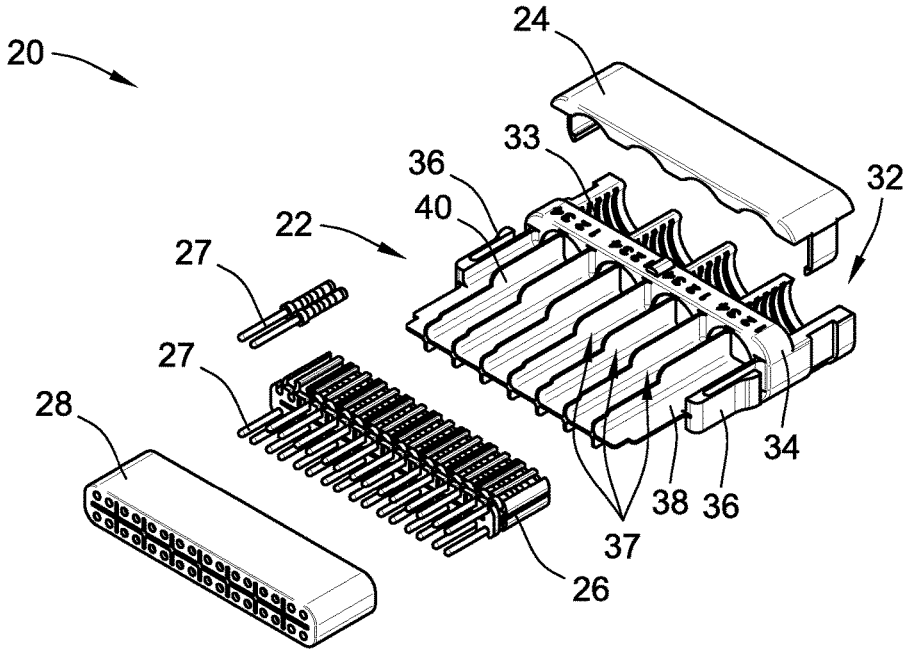
FIG. 2 is a perspective exploded view of the components of an example male connector module according to another embodiment.

Contacts 27 can be a variety of standard connectors including MIL39029 22D socket type contacts as show in FIG. 1 or MIL39029 22D plug type contacts as show in FIG. 2. Use of standard contacts lowers the overall cost of the module and provides greater flexibility and redundancy. Second insulating member 28 is composed of a similar material to first insulating member 26 and in one embodiment, includes openings 42 to stabilize at least a portion of contacts 27. Second insulating member 26 provides an electrical insulating barrier between contacts 27 and a connector shell or housing into which module 20 is inserted. Second insulating member 26 also provides additional retention stability for contacts 27.

Figure 1A:
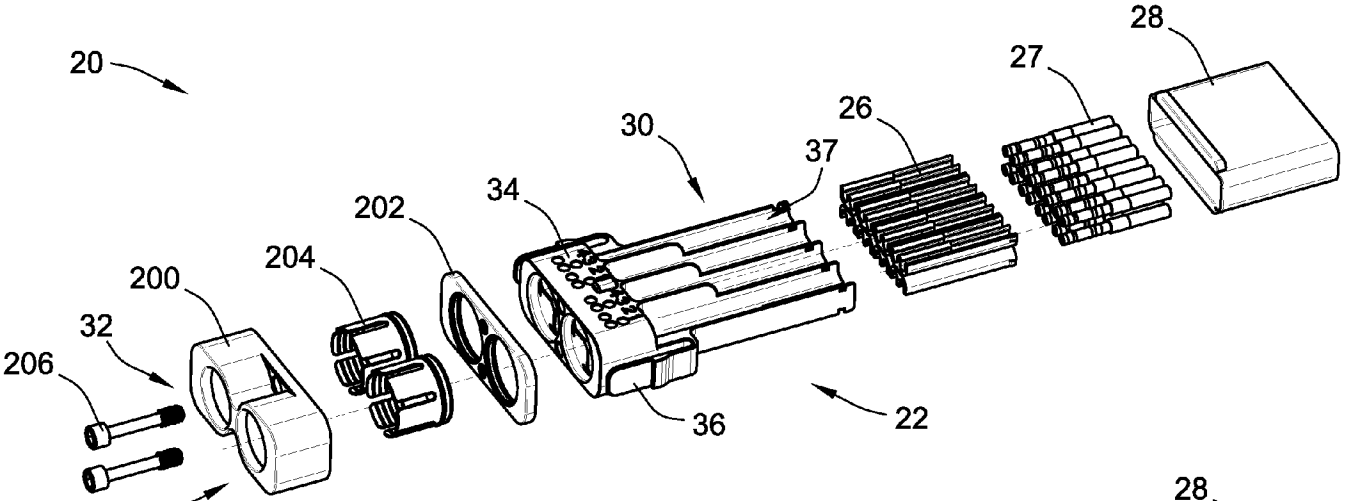
FIG. 1A is a perspective exploded view of the components of an example female connector module according to an alternate embodiment.
Figure 2A:
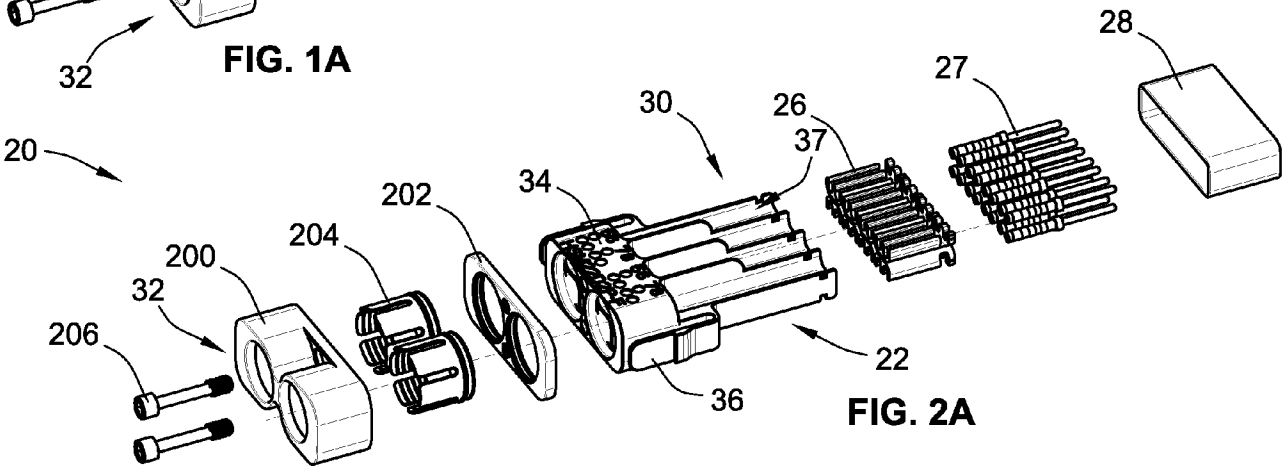
FIG. 2A is a perspective exploded view of the components of an example male connector module according to an alternate embodiment.

Referring to FIG. 1A and 2A, additional embodiments of a connector module 20 are shown, where like numbers refer to like elements of FIGS. 1 and 2. In this embodiment, one or more annular cavities 32 are formed in a bottom bracket 200 and a top bracket 202 to receive cables 44. Bottom and top brackets 200, 202 are removably coupled to junction 34 of isolator 22. In a preferred embodiment, captive screws 206 are provided to removably couple bottom and top brackets 200, 202 to junction 34 of isolator 22. Cavities 32 of bottom bracket 200 may be narrowingly tapered in the direction away from isolator 22. Shield ferrules 204 are positioned between bottom and top brackets 200, 202 to provide strain relief for a cable and ground protection from a cable ground sheath to connector 20.

Figure 2B:
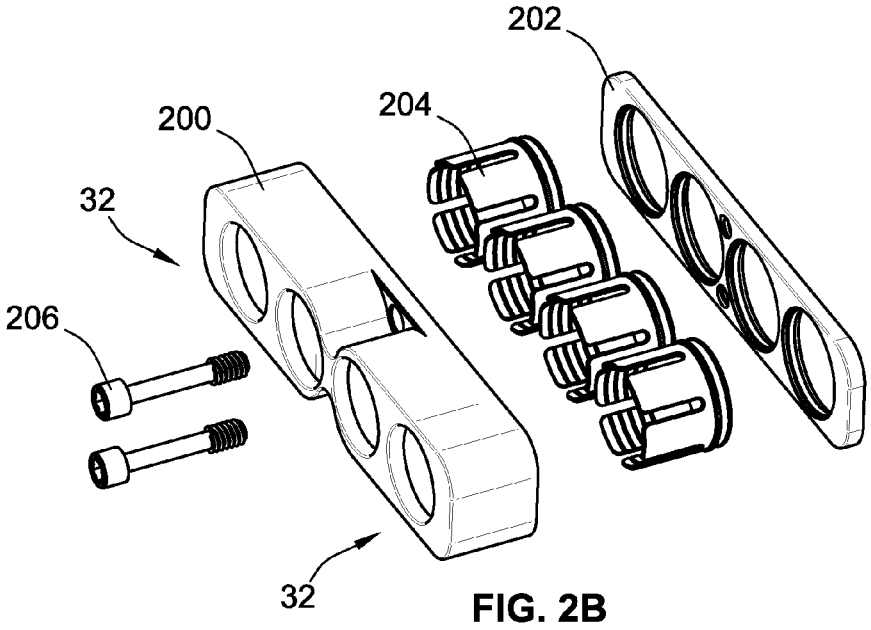
FIG. 2B is a perspective exploded view of some components of the connector module of FIGS. 1A and 2A.

As shown in further detail in FIG. 2B, bottom bracket 200, and corresponding top bracket 202 and shield ferrules 204, may be provided with varying numbers of cavities 32 to accommodate various cable types, diameters, and configurations. In the embodiment shown, bottom bracket 200 is provided with four cavities of identical diameter. In other embodiments, bottom bracket 200 may be provided with a plurality of cavities 32 having different diameters to accommodate different cable types and/or diameters in a single connector 20. Coupling isolator 22 with different bottom and top brackets 200, 202 thereby provides a modular and interchangeable cavity portion 32 within connector 20.

Figure 2C:
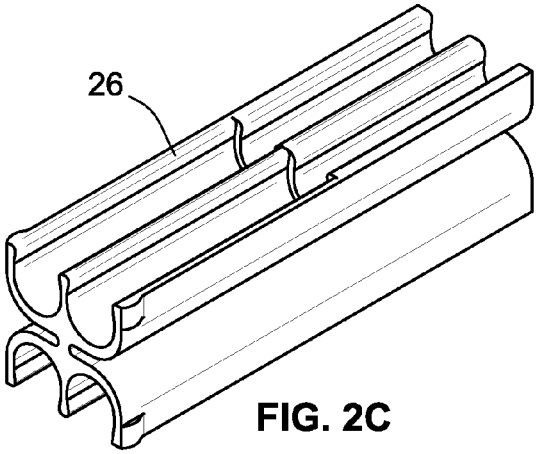
FIG. 2C is a perspective view of a modular socket isolating component of the connector module of FIGS. 1A and 2A.
Figure 2D:
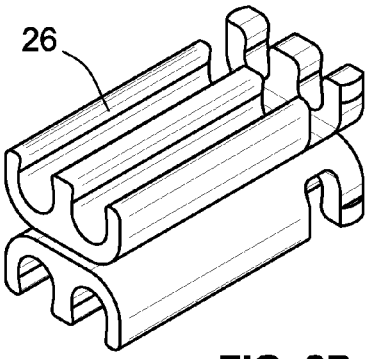
FIG. 2D is a perspective view of a modular pin isolating component of the connector module of FIGS. 1A and 2A.

Additionally, as shown in FIG. 2C and 2D, modular second insulating members 26 may be provided. In the embodiments shown, each second insulating member 26 can accommodate 4 individual wires (i.e., two twisted pairs) in a socket configuration (FIG. 2C) or a pin configuration (FIG. 2D). Accordingly, second insulating members 26 can also be varied to accommodate various cable types and configurations within connector 20.

Figure 3:
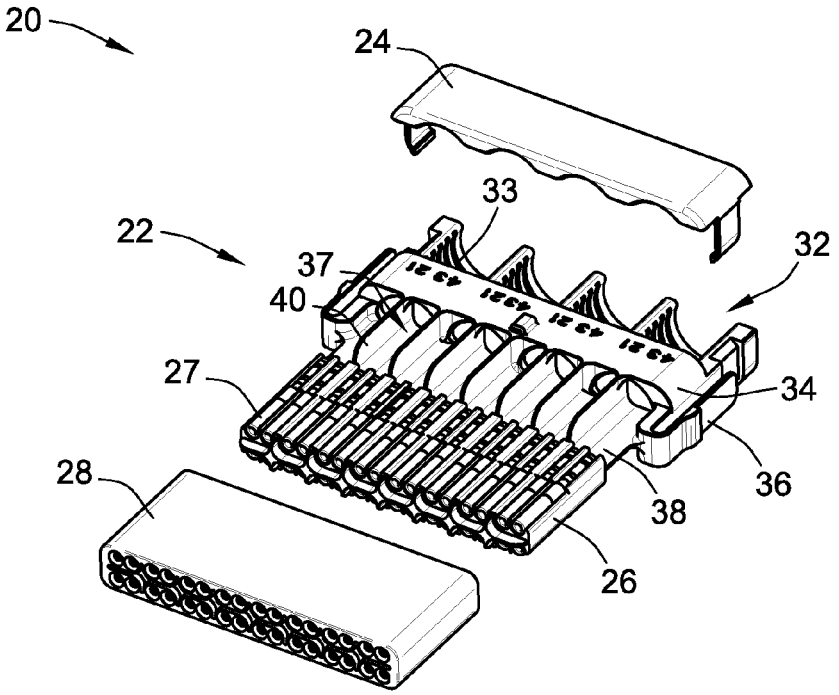
FIG. 3 is a perspective partially exploded view of the connector module of FIG. 1 showing certain components joined together.
Figure 4:
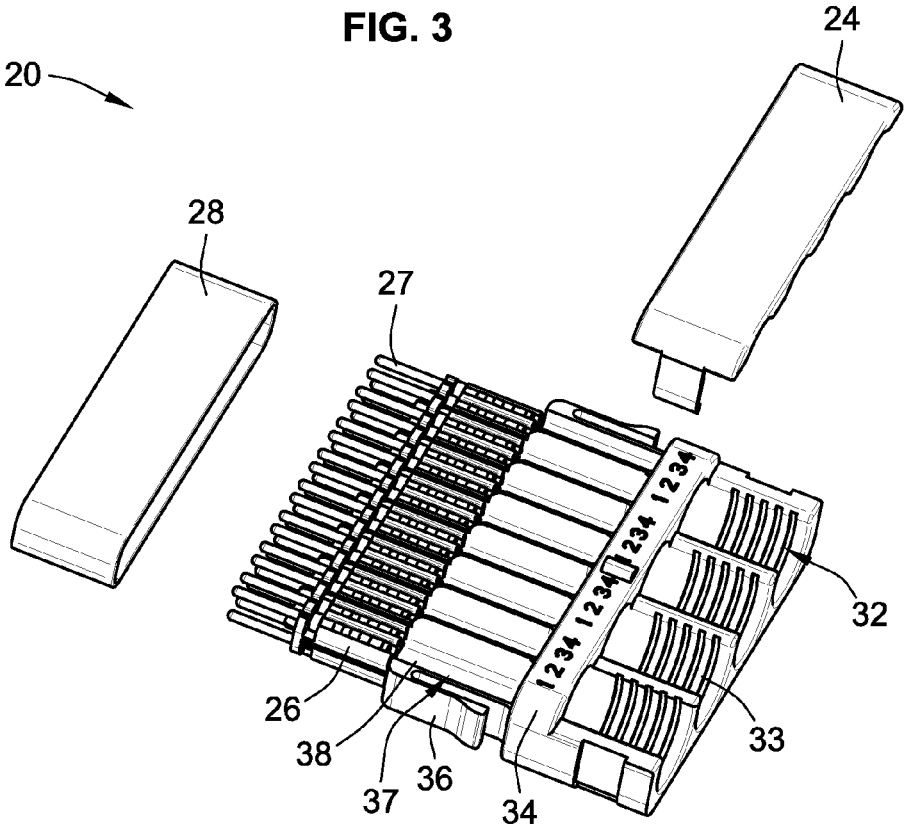
FIG. 4 is a perspective partially exploded view of the connector module of FIG. 2 showing certain components joined together.

Referring now to FIG. 3 and FIG. 4, example embodiments having first insulating member 26 slidably coupled to at least a portion of the horizontal walls 38 and vertical walls 40 of channels 37 are shown. In one embodiment, first insulating member 26 includes cutouts sized to match the forward portion of the walls 38 and 40. Use of a separate component that slides onto isolator 22 increases the robustness and reparability of module 20 by allowing the reuse of parts and ensuring that damage to the insulating material is easily replaceable.

Referring now to FIGS. 5-8, various embodiments of assembled module 20 coupled to cables 44 are shown. Cables 44 are comprised of a plurality of twisted pairs of wires 46. Cables 44 are fed into cavities 32 and terminate at junction 34 where each of the twisted pair of wires is separated into a different channel 37. As show in FIG. 6, twisted pairs 46 are stripped and contacts 27 are crimped onto the individual wires. The linear or rectangular configuration of isolator 22 as shown in FIG. 1 allows for multiple electrical connectors 27 (e.g. ethernet ports) to reside in a very compact platform (i.e. highly populated contact density). The configuration of the horizontal and vertical walls can electrically isolate twisted pairs of wires 46 that are passed into each channel 37 and maintain twisting formation very close to contacts 27. This linear configuration on each side of the horizontal wall 38 minimizes signal losses such as near end cross talk (NEXT), return loss (RL), and/or insertion loss (IL). Surprisingly, the spacing of the contacts is critical to the return loss performance of the mated pair. It has been found that the spacing of the contacts provides a blended impedance between the contact to contact impedance and the wire to wire impedance directly behind the contacts. The blended impedance optimizes the return loss performance. In a preferred embodiment, the spacing between pins is between about 0.040" and 0.100", and more preferably between about 0.060" and 0.080", and still more preferably about 0.070".

Isolator 22 and top isolator 24 or bottom bracket 200 provide a grounded path for interference signals which also helps to reduce signal degradation. In one embodiment, isolator 22 includes a polarization key or formation 35 and contact information 39 to identify the proper interfacing orientation and contact positioning/location when module 20 is placed within a connector shell. The segmented component design of module 20 allows for easy installation of cables such as cable 44 and simple field repair.

Figure 5A:
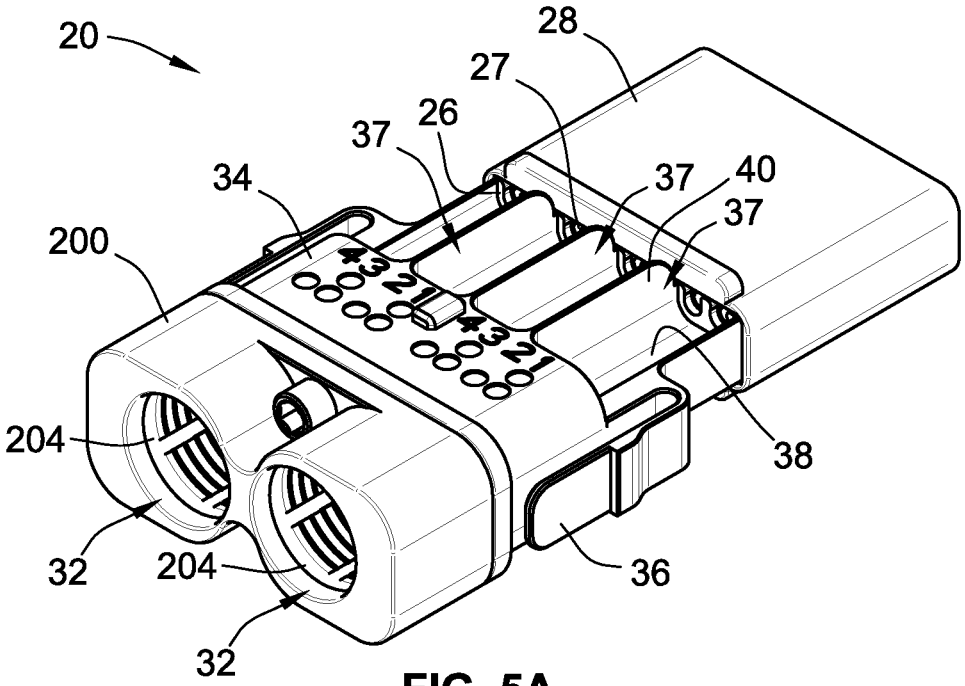
FIG. 5A is a perspective view of the module of FIG. 1A.
Figure 7A:
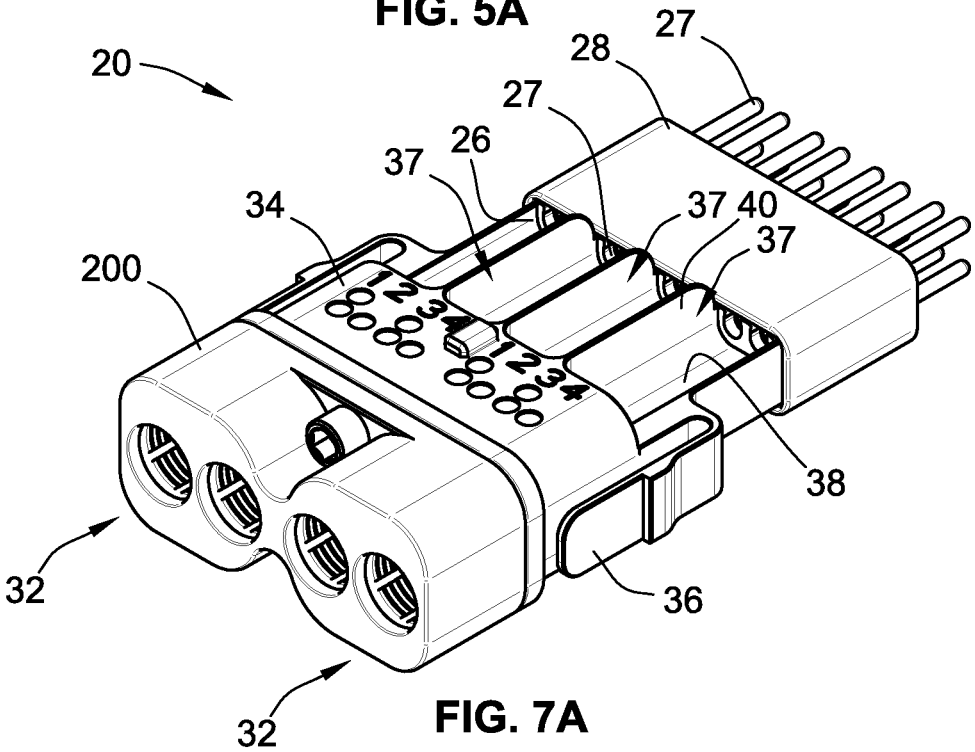
FIG. 7A is a perspective view of an assembled module according to FIG. 2A and 2B.
Figure 7:
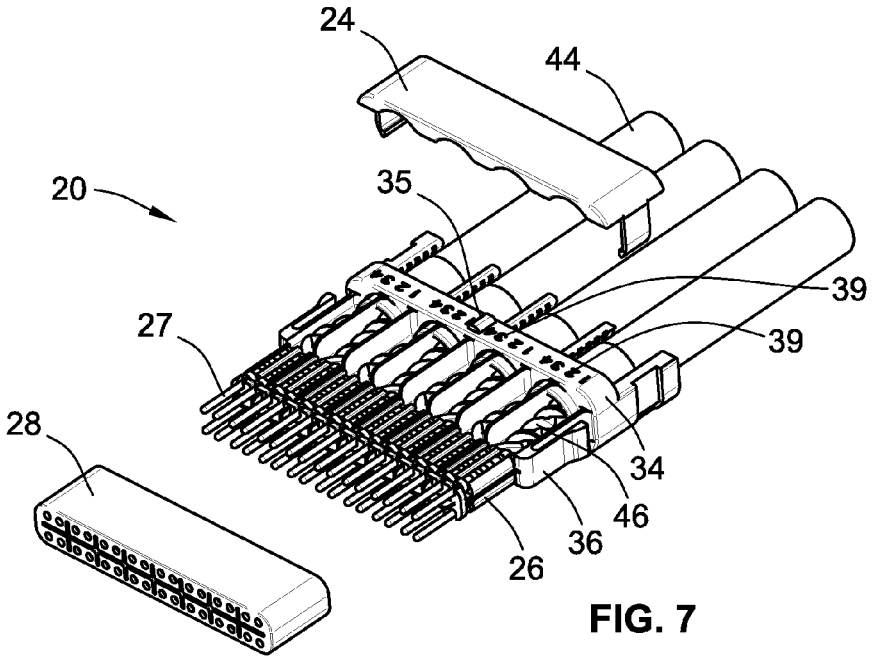
FIG. 7 is a perspective view of the module of FIG. 2 including cables and wires.
Figure 8:
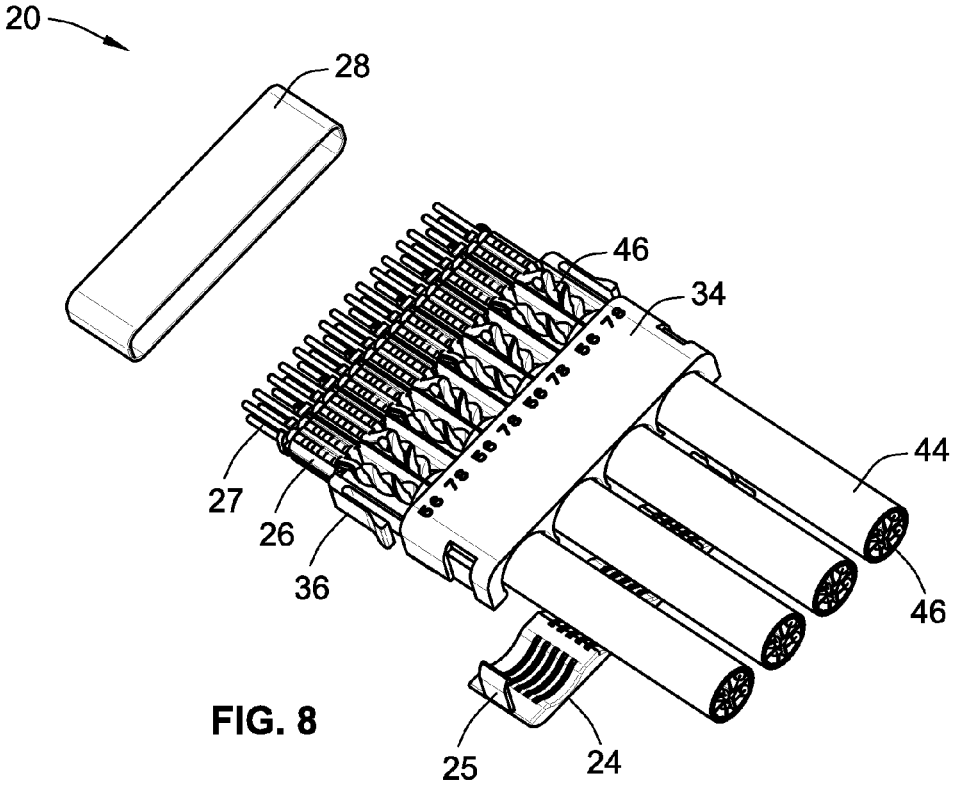
FIG. 8 is a perspective view of the bottom of the module of FIG. 7.

Further referring to FIGS. 5A and 7A, assembled connectors 20 of the embodiments of FIGS. 1A and 2A, respectively, are shown without cables 44. Cables 44 may be fed into cavities 32 of bottom bracket 200 and coupled to shield ferrules 204. Additionally, cables 44 may be terminated at junction 34, routed within isolator 22, and coupled to contacts 27 as described above with regard to FIGS. 5-8.

Figure 9:
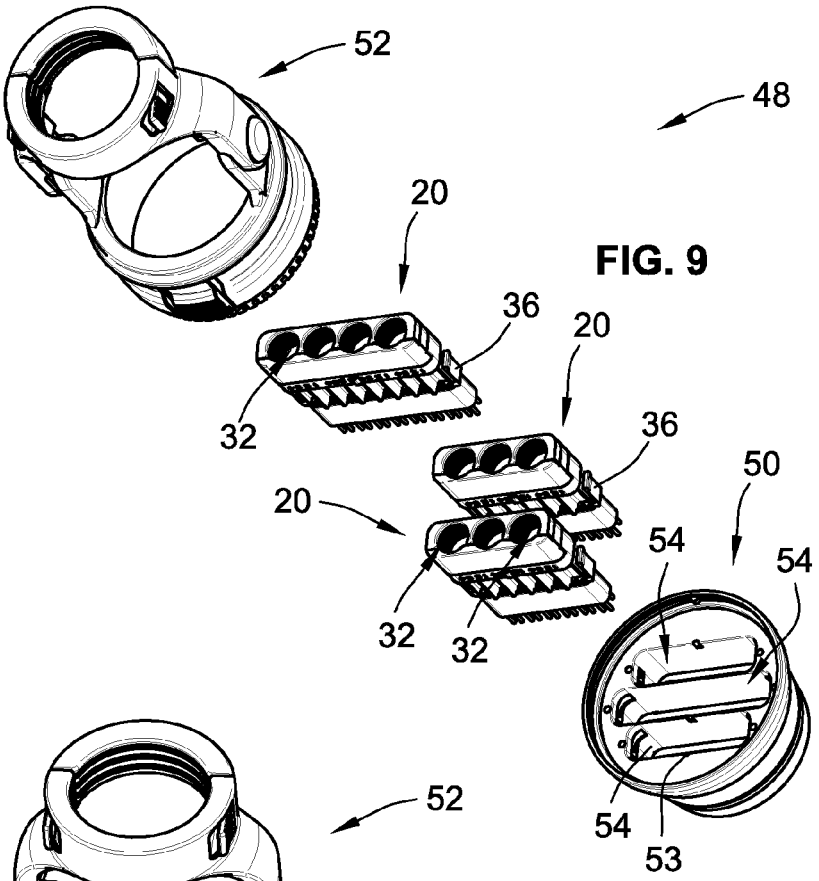
FIG. 9 is a perspective partially exploded view showing an example connector inserted into an example connector body.
Figure 10:
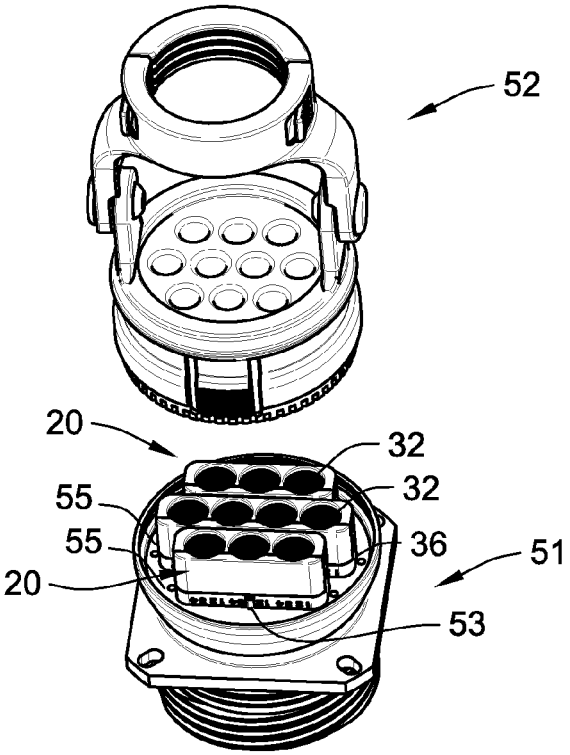
FIG. 10 is a perspective view showing an example connector inserted completely into another example connector body.

Referring now to FIG. 9, an embodiment of module 20 inserted into a connector system or housing 48 is shown. Housing 48 includes a connector shell 50 and a backshell 52. Backshell 52 includes through conduits or cavities 54 into which modules 20 are inserted and secured. FIG. 10 shows an alternative embodiment of housing 48 having a socket connector shell 51 including through conduits or cavities 55 into which modules 20 are inserted and secured. In one embodiment, connector shell 50 and socket connector shell 51 are standard connector components such as the D38999 system used by the military (see also FIG. 13). In one embodiment, conduits 54 and 55 have a key notch 53 that aligns with the polarization key 35 on modules 20 to provided consistent and proper orientation of modules 20 within conduits 54 and 55.

Figure 11:
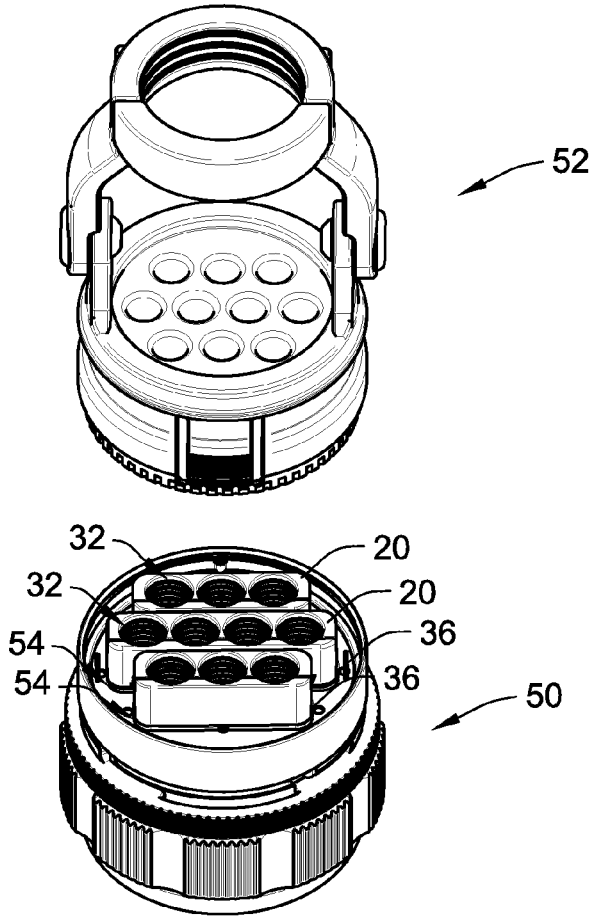
FIG. 11 is a perspective view showing an example connector inserted completely into a connector body as shown in FIG. 9.
Figure 12:
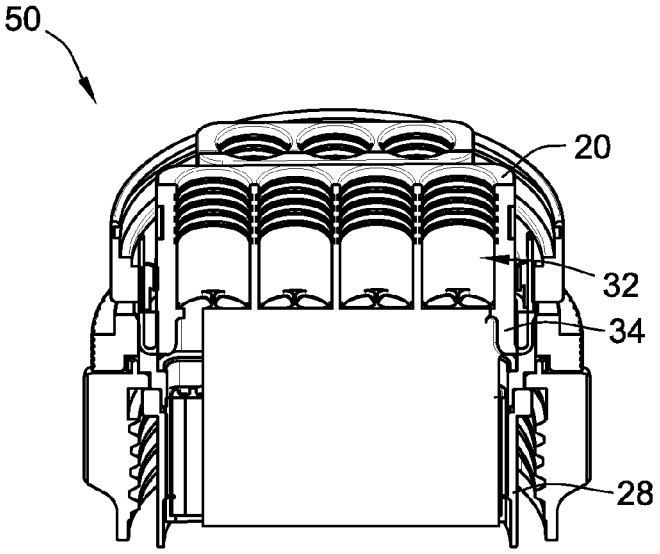
FIG. 12 is a cross-sectional view of the assembled connector body and modules of FIG. 11.

Referring now to FIG. 11. and FIG. 12, modules 20 are shown coupled into connector shell 50 by tangs 36. Tangs 36 are integrally formed with isolator 22 and provide a mechanical retention force when inserted in conduits 54 or 55 of connector shell 50 and socket connector shell 51. Tangs 36 also provide electrically conductive paths for cables 44 over cavities 32 to a connector shell 50 or socket connector shell 51 in which modules 20 are inserted. This path is an important factor for EMI shielding effectiveness. In one embodiment, tangs 36 can be compressed without the use of a tool. Compression of tangs 36 lessens the retention force and facilitates removal of modules 22 from connector shell 50. As show in FIG. 12 tangs 36 provide the electrical conductive ground path for the cavities 32 to the connector shell 50.

Figure 13:
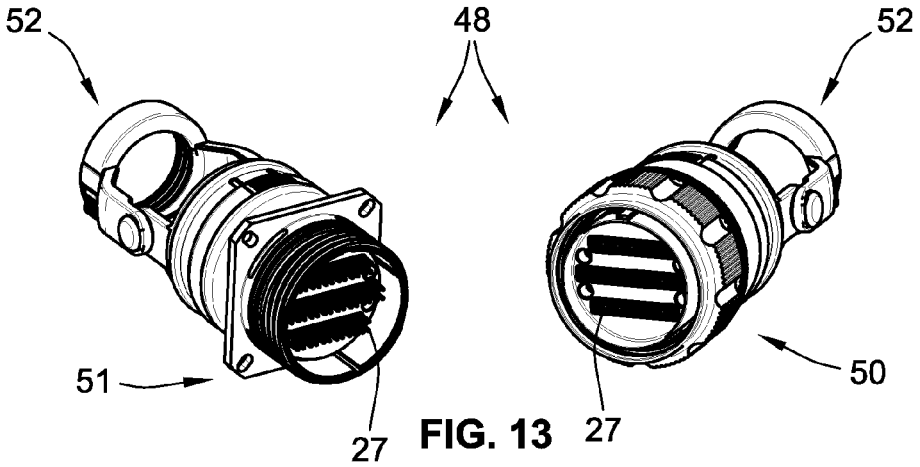
FIG. 13 is a perspective view of the connector modules of FIG. 1 and FIG. 2 shown in 2 example, mating connector bodies.
Figure 14:
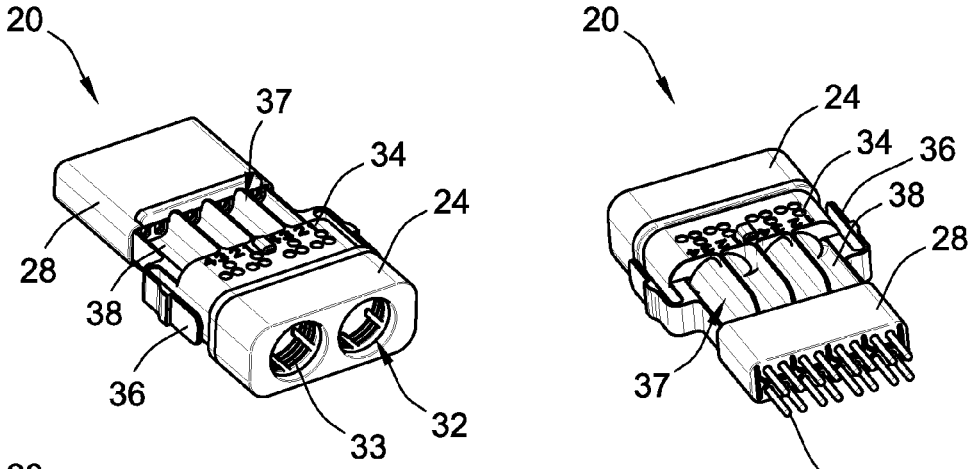
FIG. 14 is a perspective view of mating connector modules according to an alternative embodiment.
Figure 15:
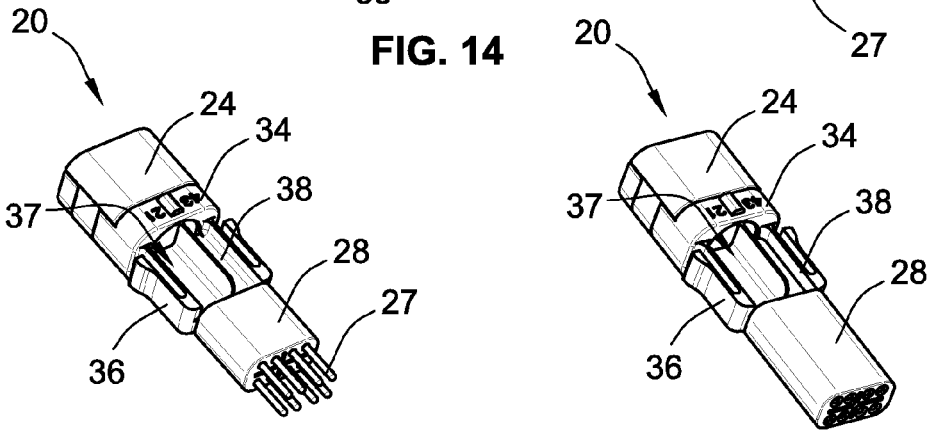
FIG. 15 is a perspective view of mating connector modules according to an alternative embodiment.
Figure 31:
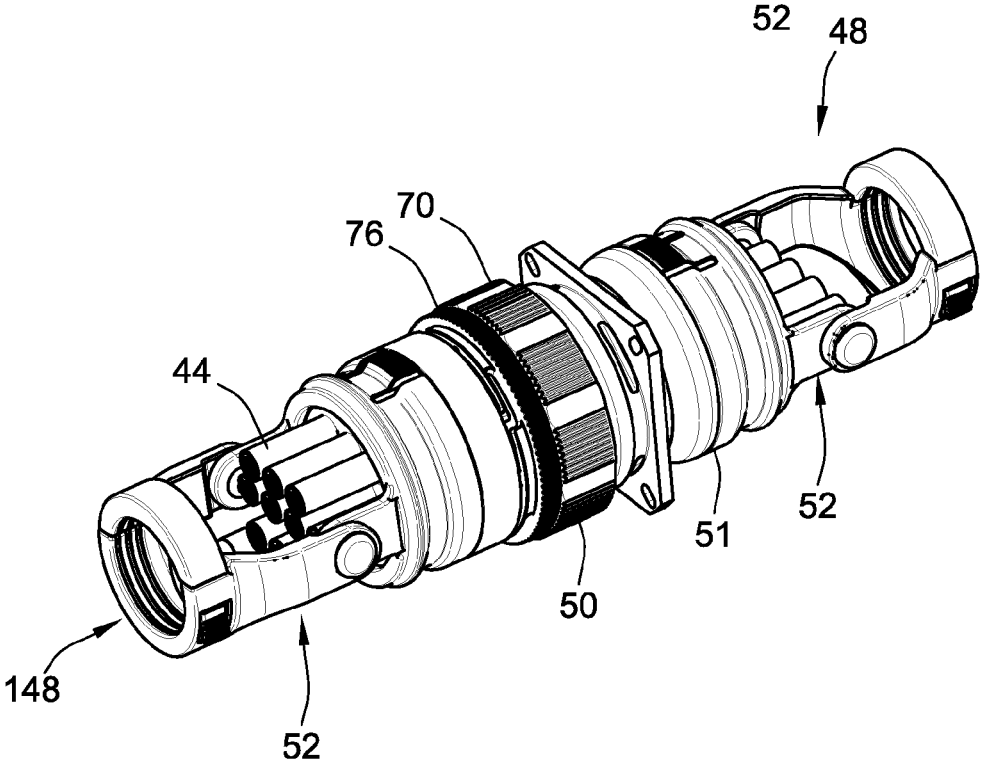
FIG. 31 is a perspective view showing two example connector bodies joined together.

Referring now to FIG. 13, completely assembled embodiments of housing 48 are shown. Housing 48 using socket connector shell 51 contains modules 20 using plug type contacts 27 (see FIG. 2), and housing 48 using connector shell 50 contains modules 20 using socket type contacts 27 (see FIG. 1). This configuration of module and contact types allows for the two housings 48 to interconnect and allow an electrical signal to pass between the modules 20 of both housings (see FIG. 31). FIGS. 14 and 15 show additional embodiments of modules 20 for terminating a different numbers of cables 44. The use of different size modules allows for the increased density not present in existing connector solutions. Further, the different sized modules allow for greater flexibility in laying out complex cable runs for a multi cable system. The modular design and varying sizes also allow for easy adaptation to connector systems other than the standard circular D38999 system used by the military.

Figure 16:
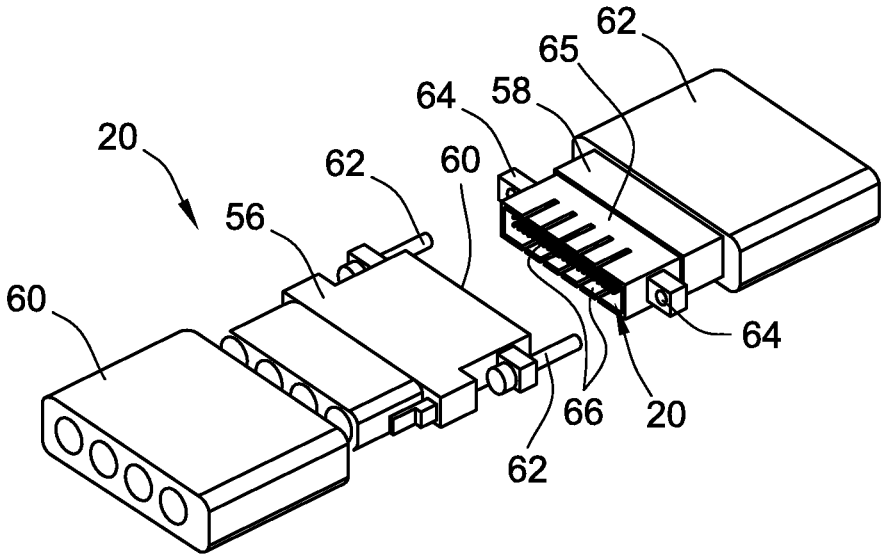
FIG. 16 is a perspective view of the connector modules of FIG. 1 and FIG. 2 shown in 2 alternative example connector bodies.
Figure 17:
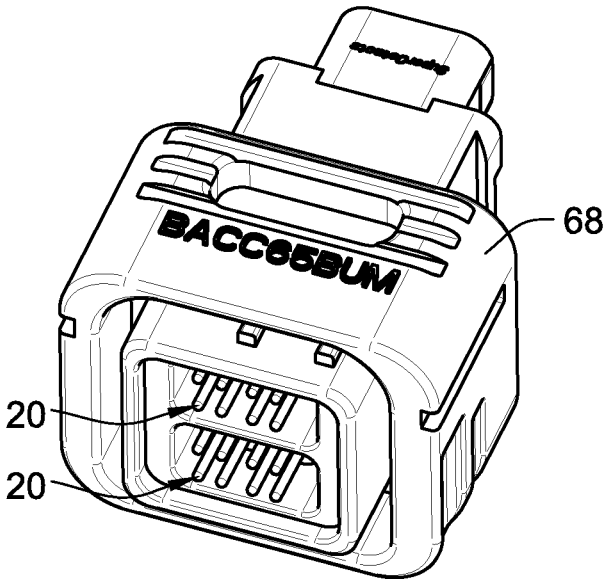
FIG. 17 is a perspective view of example connector modules in an alternative connector body.

Referring now to FIGS. 16 and 17, alternative connector options are shown. FIG. 16 shows a 4 port version of module 20 with custom first and second rectangular shells 56 and 58 respectively. First rectangular shell 56 includes a cover 60 and couplers 62. Second rectangular shell 58 includes an insert 65 having flanges 66 and receiving extensions 64. Insert 65 is sized and shaped to fit within and be surrounded by cover 60. Flanges 66 engage with an inner surface of cover 60 to increase the coefficient of friction and resist movement to secure insert 65 within cover 60. Couplers 62 are joined to receiving extensions 64 to further secure the connection. First and second rectangular housings 56 and 58 further include first and second seal boots 60 and 62 coupled to the end of modules 20 to help secure and direct cables such as cables 44, and to protect the connectors 56 and 58 from the environment. In one embodiment, first and second seal boots are manufactured from an insulating material such as that used to manufacture first and second insulating members 226 and 28. FIG. 17 shows a 2 port version of modules 20 fit into an EN4165/BACC65 standard connector platform. It should be understood that various additional standard and custom connector platforms containing modules of various sizes are contemplated.

Figure 18:
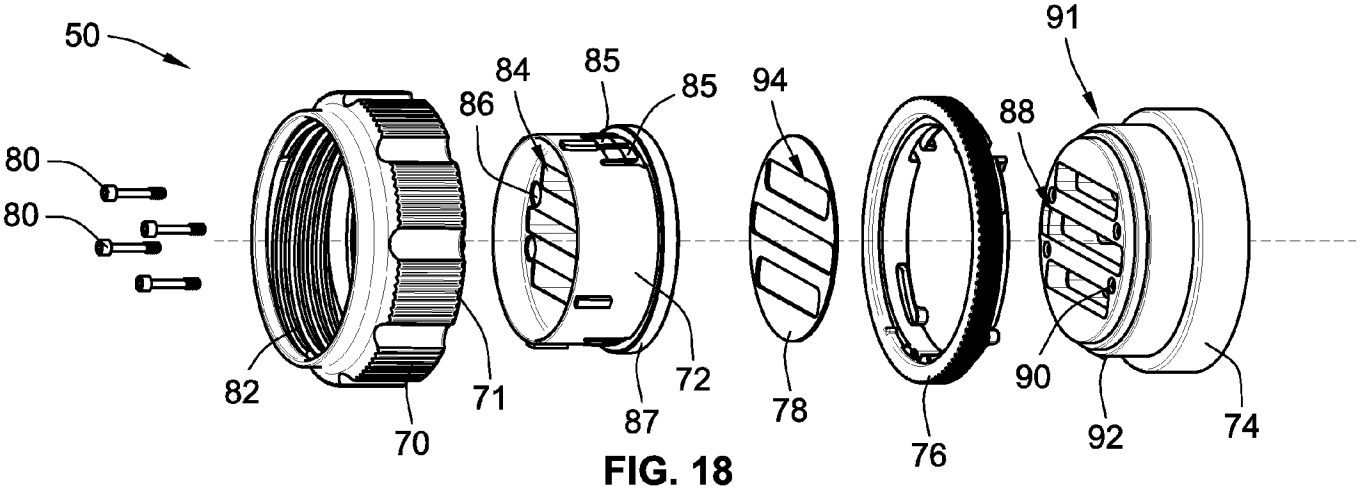
FIG. 18 is a perspective view of an example connector body that is resistant to decoupling.
Figure 19:
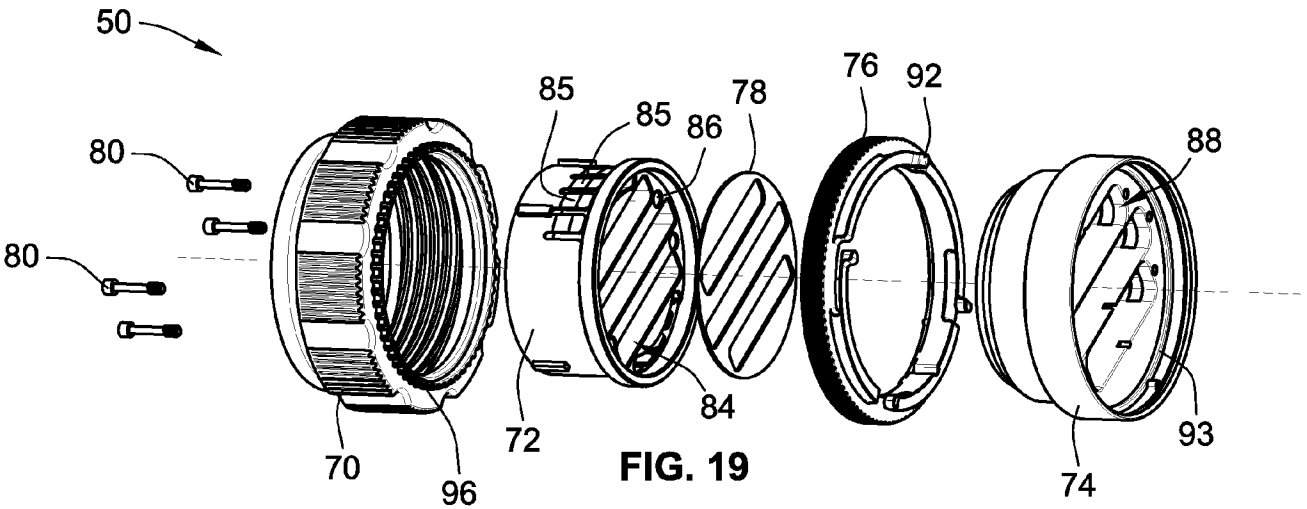
FIG. 19 is an alternative perspective view of the connector body of FIG. 18.

Referring now to FIG. 18 and FIG. 19, connector shell 50 is shown as a modified version of the standard D38999 connector platform. Connector shell 50 includes a completely secured anti-decoupling mechanism. The coupling/mating force is significantly reduced in comparison to the industry standard shell due to the elimination of the detent mechanism. Connector shell 50 is simpler and has fewer components than industry standard D38999 shells and inserts. Connector shell 50's components are designed for fast and easy assembly. Replacement or field repair of the connector 50 and its components can be accommodated quickly. Connector shell 50 can be used in other applications such as highly populated fiber optic termini and/or conventional contacts as well as in the severe shock and vibration environment. In one embodiment, connector shell 50 and its components allow for more parts to be CNC machined than the standard D38999.

In one embodiment, connector shell 50 includes a coupling nut 70, a top insert 72, a bottom insert 74, an anti-decoupling ring 76, a gasket 78, and securing members 80. Coupling nut 70 includes a first engagement structure 82 and a second engagement structure 96 (see FIG. 19). First engagement structure 82 is designed to couple connector shell 50 to a socket connector shell such as socket connector shell 51 as show in FIG. 31. Second engagement structure 96 engages with anti-decoupling ring 76 so that rotation of the coupling nut and rotation of the anti-decoupling ring are linked. In one embodiment, first engagement structure 82 is female threads and second engagement structure 96 is a gear mechanism. Coupling nut 70 can also include grip ridges 71 that make griping and turning, either with a tool or by hand, coupling nut 70 easier. Top insert 72 includes one or more conduits 84, grounding tangs or flanges 85, through holes 86, and lip 87. Bottom insert 74 includes one or more conduits 88, retaining holes 90, a ridge structure 91, a locking flange 92 and a backshell engagement structure 93 for coupling connector shell 50 to a backshell such as backshell 52. Locking flange 92 may be an integrally formed projection from the surface of bottom insert 74 or may be a standard dowel pin secured in a cutout on the surface of bottom insert 74. Gasket 78 includes a plurality of cutouts 94.

Figure 20:
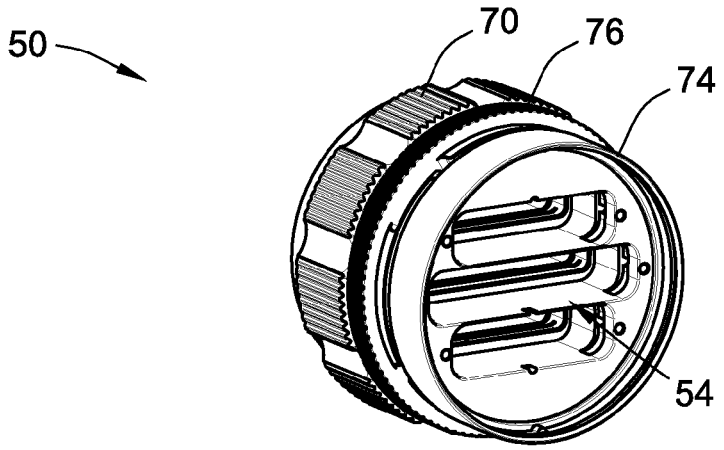
FIG. 20 is a perspective view of the fully assembled connector body of FIG. 17 and FIG. 18.

Connector shell 50 is fully assembled (see FIG. 20) by inserting top inset 72 within coupling nut 70. Gasket 78 is placed on the rear end of top insert 72 such that cutouts 94 are aligned with conduits 84. Anti-decoupling ring 76 is disposed around a portion of the top and bottom inserts 72 and 74 and engages with the second engagement structure 96 of coupling nut 70. Lip 87 fits over rigid structure 91 of bottom insert 74 and aligns conduits 88 with conduits 86 and cutouts 94. Securing members 80 are partially passed through through holes 86 and engage with retaining holes 90, and then are tightened to securely fasten all of the components together. Various embodiments of connector shell 50 having greater or fewer securing members 80 than show in FIG. 18 and FIG. 19 are contemplated. In one embodiment, securing members 80 are standard captivated screws. In another embodiment, gasket 78 is replaced with a standard O-ring. When fully assembled, as show in FIG. 20, aligned conduits 84 and 88 and cutouts 94 form through conduits 54 in which connector modules 20 can be secured.

Figure 18A:
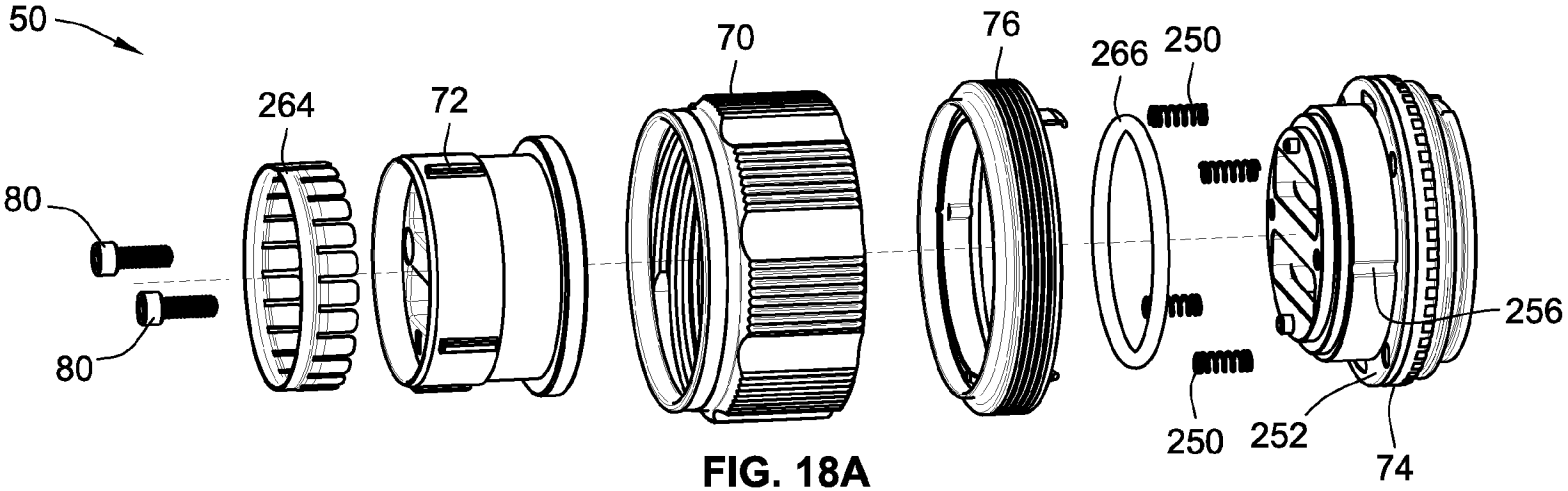
FIG. 18A is a perspective view of a second example connector body that is resistant to decoupling.
Figure 19A:
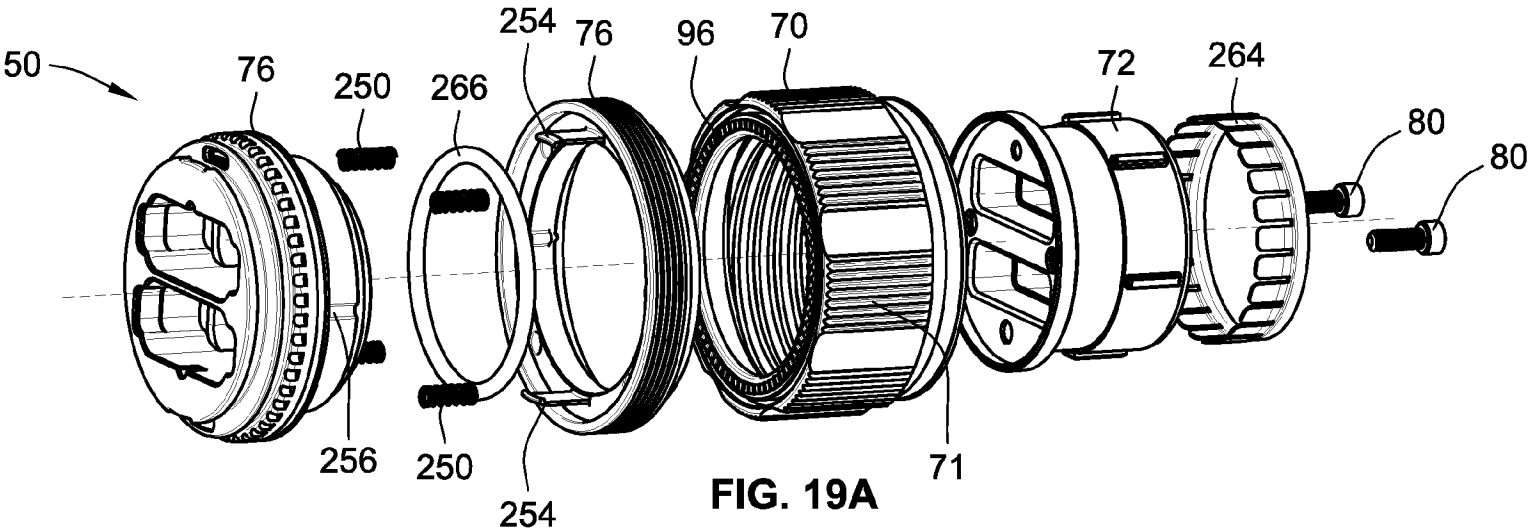
FIG. 19A is an alternative perspective view of the connector body of FIG. 18A.

Referring to FIGS. 18A and 19A, an alternate embodiment of a modified connector shell 50 is shown. Positive engagement of decoupling ring 76 against second engagement structure 96 of coupling nut 70 may alternately be provided by one or more springs 250 disposed between bottom insert 74 and anti-decoupling ring 76. Springs 250 are retained in position by insertion into recesses 252 of bottom insert 74, and corresponding recesses 254 of decoupling ring 76. Anti-decoupling ring 76 is thereby moveable between a first position in engagement with coupling nut 70 wherein anti-decoupling nut 76 is engaged to second engagement structure 96 of coupling nut 70, and a second position disengaged from second engagement structure 96. Anti-decoupling ring 76 may be manually moved rearward toward bottom insert 74 by compression of springs 250 by a user. When the user releases anti-decoupling ring 76, springs 250 return the anti-decoupling ring to the first position. As shown, this embodiment includes a standard O-ring 266 instead of a gasket 78, and a conductive grounding ring 264.

Figure 22:
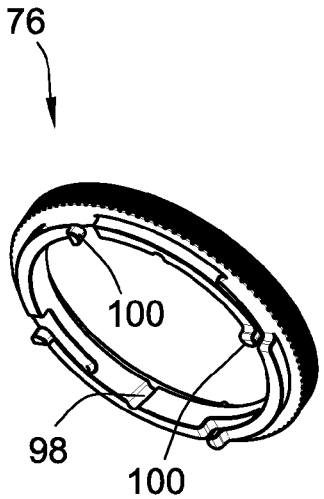
FIG. 22 is a perspective view of one side of an anti-decoupling ring of the connector body of FIGS. 17-19.
Figure 23:
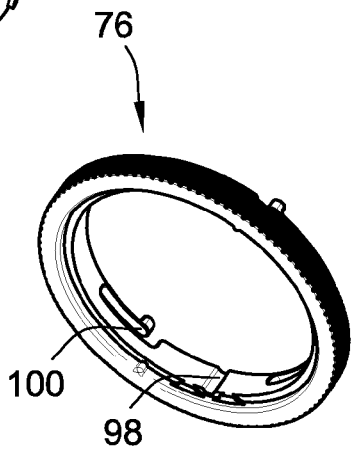
FIG. 23 is a perspective view of the opposite side of the anti-decoupling ring of FIG. 22.
Figure 22A:
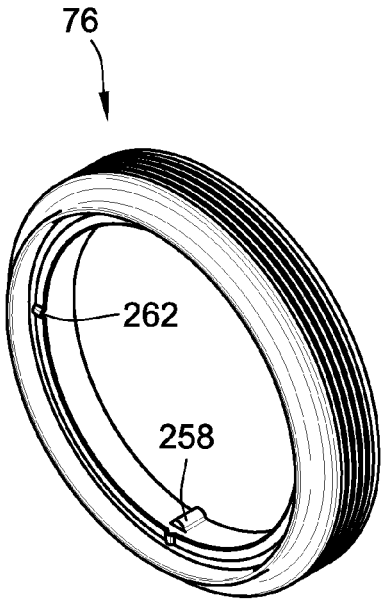
FIG. 22A is a perspective view of one side of a second embodiment of an anti-decoupling ring.
Figure 23A:
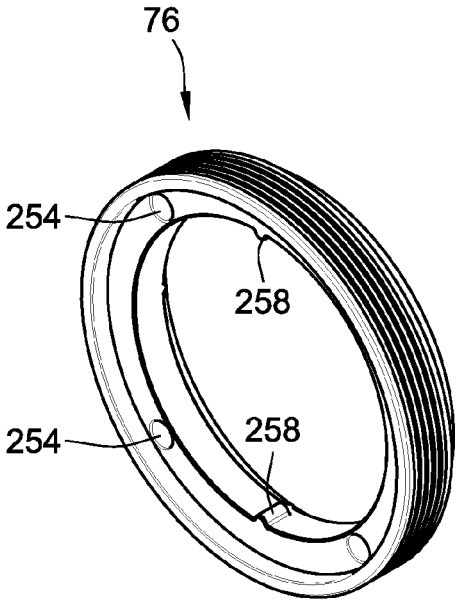
FIG. 23A is a perspective view of the opposite side of the anti-decoupling ring of FIG. 22A.

As best shown in FIGS. 22A and 23A, decoupling ring 76 includes one or more rotational alignment protrusions 258 suitable for engagement with corresponding notches 256 of bottom insert 74. When rotational alignment protrusions 258 are slideably engaged to notches 256, rotation of anti-decoupling ring 76 with respect to bottom insert 74 is prevented. Accordingly, when anti-decoupling ring is in the first position in engagement with coupling nut 70, coupling nut 70 is prevented from rotating due to vibration, accidental movement, etc. Anti-decoupling ring may be moved rearward towards bottom insert 74 by manual compression of spring 250, thereby allowing free rotation of coupling nut 70.

Figure 21:
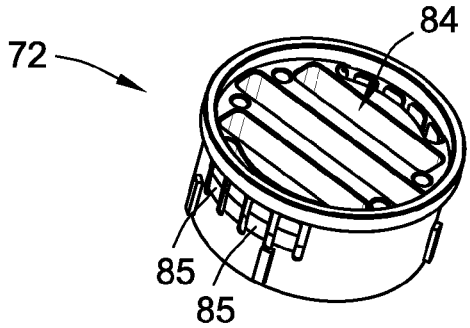
FIG. 21 is a perspective view of a top insert of the connector body of FIGS. 17-19.

Referring now to FIG. 21, a standalone perspective view of top insert 72 is shown. Tangs 85 of top insert 72 provide for continuous grounding, which provides low DC resistance when connector shell 50 is coupled to a socket connector shell such as socket connector shell 51. In an alternative embodiment, tangs 85 are removed and are replaced by conductive ring 264, which provides for the same continuous grounding.

Referring now to FIG. 22 and FIG. 23, standalone perspective views of both sides of anti-decoupling ring 76 are shown. Anti-decoupling ring 76 includes a notch or groove 98 and tangs or flanges 100. When placed in fully assembled connector shell 50 notch 98 can selectively be engaged with locking flange 92 by compressing and rotating ant-decoupling ring 76. Notch 98 is also engaged with locking flange 92 by the application of the typical forces that cause coupling nut 70 to decouple from a socket type connector. When notch 98 is engaged with locking flange 92 it prevents rotation of anti-decoupling ring 76 which in turn prevents rotation of coupling nut 70 through the engagement with second engagement structure 96. In one embodiment the engagement is caused by tangs 100, which provides a spring forward self-latching interface with second engagement structure 96 of coupling nut 70. Tangs 100 also provide a grounding path for anti-decoupling ring 76.

Additionally referring to FIGS. 22A and 23A, standalone perspective views of both sides of the anti-decoupling ring of FIGS. 18A and 19A are shown. In this embodiment, anti-decoupling ring 76 includes one or more rotational alignment protrusions 258 suitable for engagement with a corresponding notch 256 of bottom insert 74 to prevent rotation of the anti-decoupling ring with respect to the bottom insert 74. Additionally, anti-decoupling ring 76 is shown with protrusions 262 suitable for locking engagement with second engagement structure 96 of coupling nut 70.

Figure 22B:
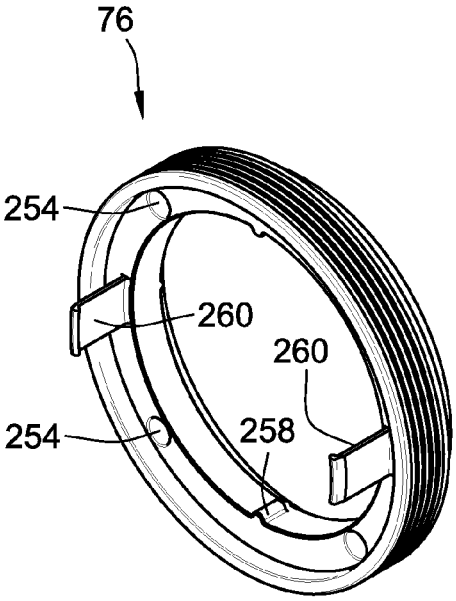
FIG. 22B is a perspective view of one side of a third embodiment of an anti-decoupling ring.
Figure 23B:
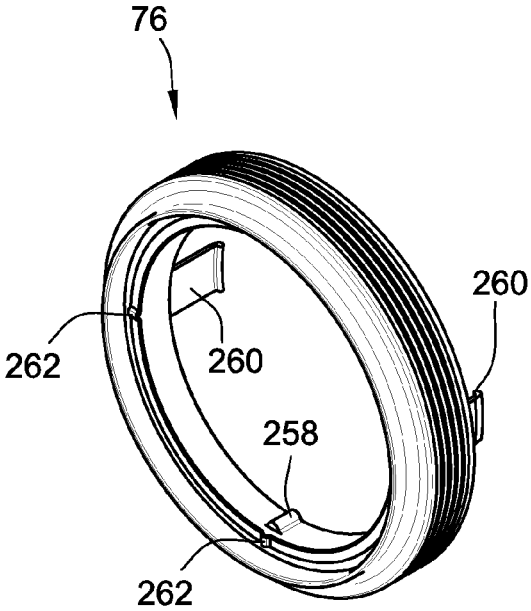
FIG. 23B is a perspective view of the opposite side of the anti-decoupling ring of FIG. 22B.

Further referring to FIGS. 22B and 23B, standalone perspective views of both sides of another embodiment of an anti-decoupling ring are shown. In this embodiment, anti-decoupling ring 76 further includes one or more tangs 260. Tangs 260 may be temporarily coupled to bottom insert 74 by a friction fit into corresponding recesses provided in bottom insert 74 when anti-decoupling ring 76 is moved in the direction of bottom insert 74. Anti-decoupling ring 76 may thereby be temporarily disengaged from the second engagement structure 96 of coupling nut 70, allowing coupling nut 70 to spin freely without further application of force to the anti-decoupling ring, for example to permit one-handed operation of the connector.

Figure 24:
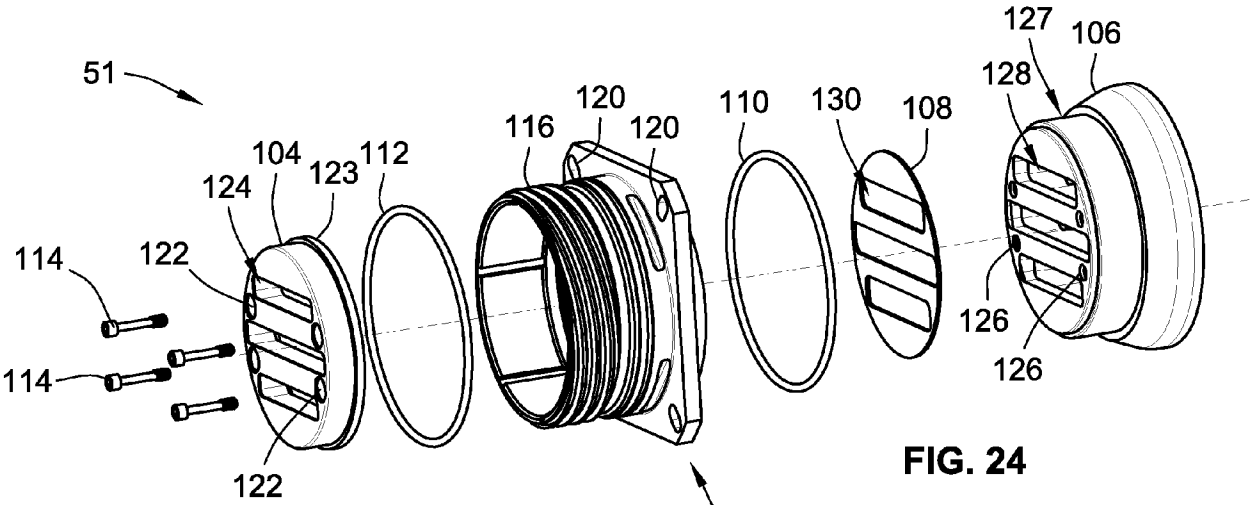
FIG. 24 is a perspective view of an example connector body according to one embodiment.
Figure 25:
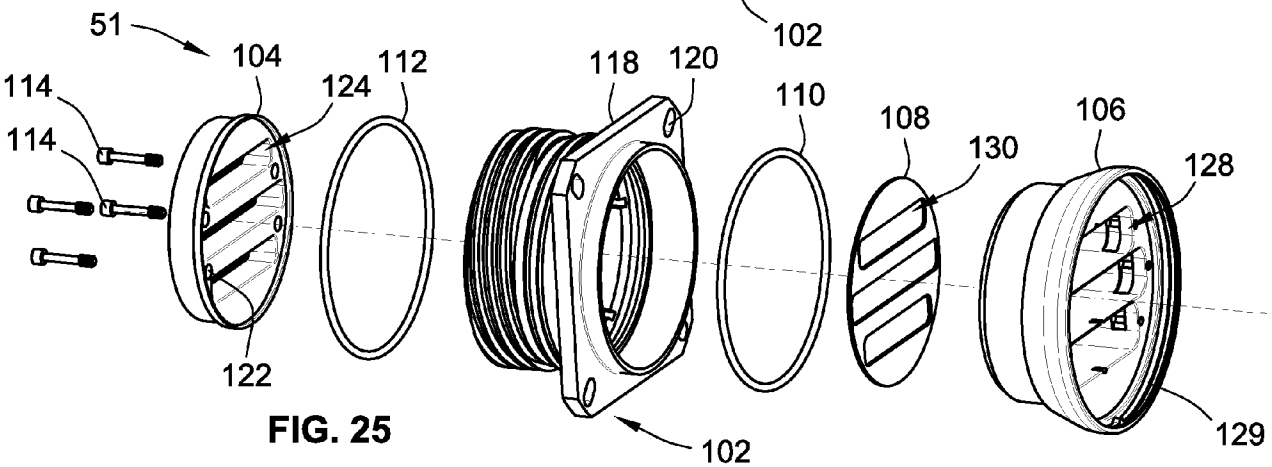
FIG. 25 is an alternative perspective view of the connector body of FIG. 24.

Referring now to FIG. 24 and FIG. 25, detailed views of socket connector shell 51 are shown. Socket connector shell 51 includes a socket shell 102, a top insert 104, a bottom insert 106, a gasket 108, a first O-ring 110, a second O-ring 112, and securing members 114. Socket shell 102 includes an engagement structure 116 and a lip 118 having fastening holes 120 for securing the complete socket connector shell 51 to a bulkhead, platform, or similar structure. The design of lip 18 enables socket connector shell 51 to be stably secured between top and bottom inserts 104 and 106 by tightening securing members 114. Engagement structure 116 is designed to couple socket connector shell 51 to a connector shell such as connector shell 50 as show in FIG. 31. In one embodiment, engagement structure 116 is male threads. Top insert 102 includes a plurality of conduits 124, through holes 122, and a lip 123. Bottom insert 106 includes a plurality of conduits 128, retaining holes 126, a ridge structure 127, and a backshell engagement structure 129 for coupling socket connector shell 51 to a backshell such as backshell 52. Gasket 108 includes a plurality of cutouts 130.

Figure 26:
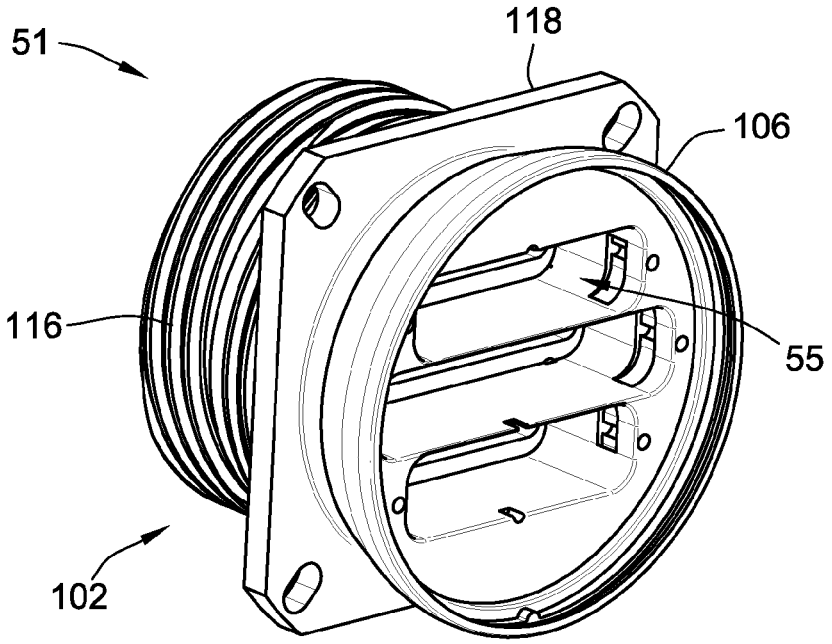
FIG. 26 is a perspective view of the fully assembled connector body of FIG. 24 and FIG. 25.
Figure 27:
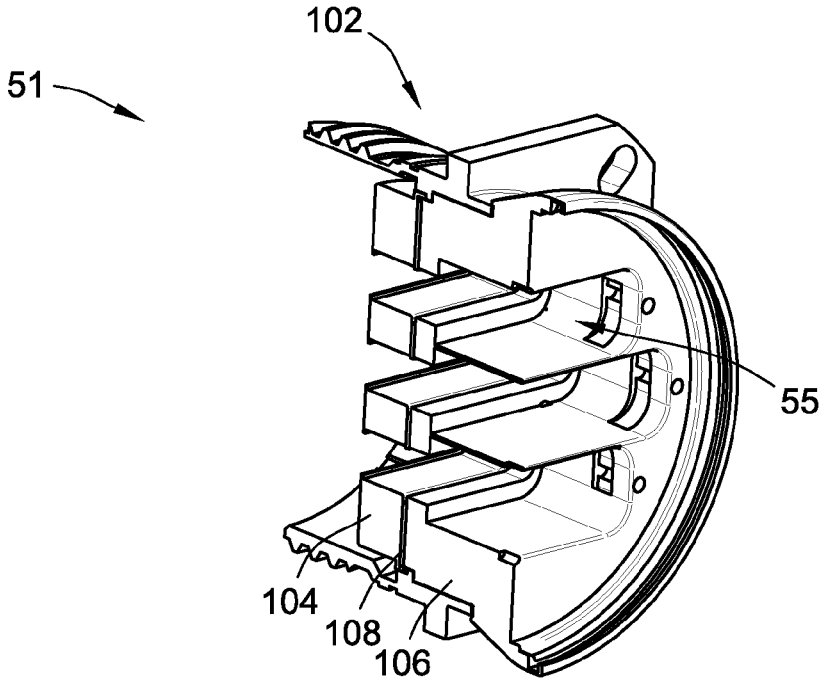
FIG. 27 is a perspective cross sectional view of the connector of FIG. 26.

Socket connector shell 51 is fully assembled (see FIG. 26) by inserting top inset 104 within socket shell 102. First and second O-rings 110 and 112 and gasket 108 are placed on the rear end of top insert 104 such that cutouts 130 are aligned with conduits 124. Gasket 130 and O-rings 110 and 112 enable socket shell 102, and top and bottom inserts 104 and 106 to be mutually conductive while also being sealed from the environment. Lip 123 fits over rigid structure 127 of bottom insert 106 and aligns conduits 128 with conduits 124 and cutouts 130. Securing members 114 are partially passed through through holes 122 and engage with retaining holes 126, and then are tightened to securely fasten all of the components together. Various embodiment of socket connector shell 51 having greater or fewer securing members 114 than show in FIG. 24 and FIG. 25 are contemplated. In one embodiment, securing members 114 are standard captivated screws. In another embodiment, gasket 130 is replaced with an additional standard O-ring. When fully assembled, as show in FIG. 26 and FIG. 27, aligned conduits 124 and 128 and cutouts 130 form through conduits 55 in which connector modules 20 can be secured. The complete socket connector shell 51 can be quickly assembled and easily taken apart with standard Allen wrench tools.

Figure 28:
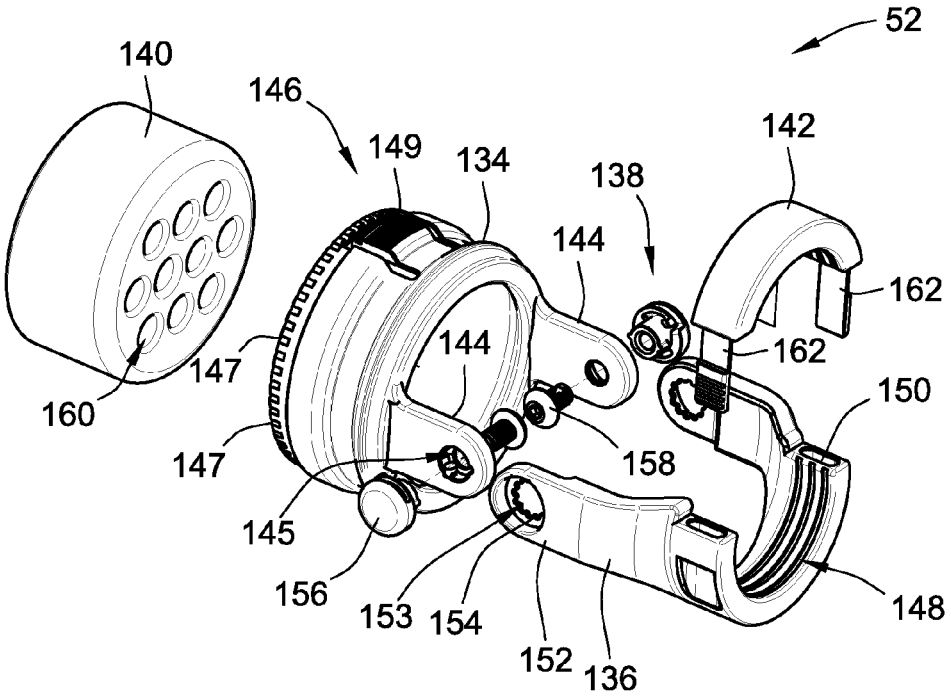
FIG. 28 is a perspective exploded view of an example backshell according to one embodiment.
Figure 29:
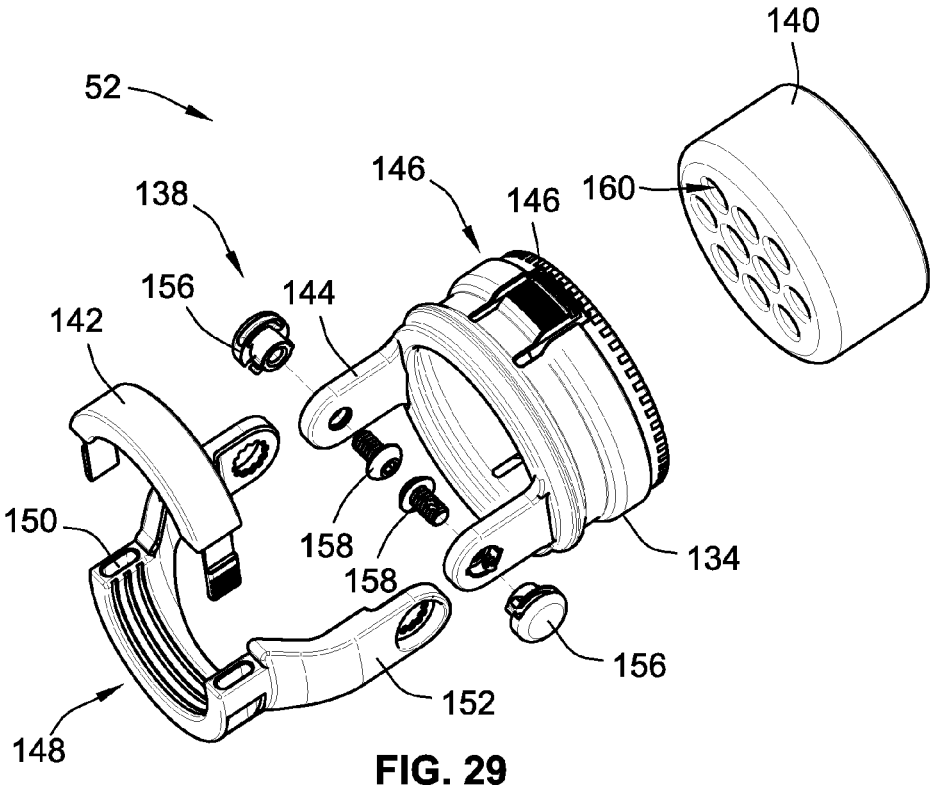
FIG. 29 is an alternative view of the backshell of FIG. 28.

Referring now to FIG. 28 and FIG. 29, detailed views of an embodiment of backshell 52 at various angles are shown. Backshell 52 is a quickly reconfigurable, multiple axis, and toolless installation backshell. Backshell 52 includes a forward member or top shell 134, a reward member 136, an engageable attachment mechanism 138, a seal grommet 140, and a clamp 142. Forward member 134 includes a first pivot structure 144. Engagement structure 146. First pivot structure 144 includes a recess 145 and engagement structure 146 selectively couples backshell 52 to a connector such as connector shell 50 or socket connector shell 51. In one embodiment, engagement structure 146 comprises tangs or flanges 149 and grooves 147. Tangs 149 provide a latching mechanism and conductive grounding path to a connected connector. Backshell 52 can be quickly disengaged from a connected connector by pressing tangs 149 inward. Grooves 147 enable proper engagement with a connector and allows for different angled orientation with that connector. Reward member 136 includes a cavity 128 for receiving a plurality of cables such as cables 44, a coupling slot 150, and a second pivot structure 152. Second pivot structure 152 includes a recess 153 having teeth 154 formed therein. Engagement structure 138 includes compressible pivoting shafts 156 and securing members 158. Clamp 142 includes a flange 162. Seal grommet 140 includes through channels 160 for retaining cables such as cables 44.

When backshell 52 is assembled, seal grommet 140 is fed into and coupled within forward member 134 and clamp 142 is coupled to reward members 148 to form an enclosed loop with cavity 148. Flange 162 is inserted into and passes through coupling slot 150 to retain clamp 142 against reward member 136. In an alternative embodiment, clamp 142 is omitted and cavity 148 is an enclosed loop. First pivot structure 144 is placed inside the footprint of second pivot structure 152 such that recesses 145 and 153 are aligned. In an alternative embodiment the reverse orientation is used. Pivoting shafts 156 are fed through one side of aligned recesses 145 and 153 and are secured to securing members 158. When not compressed pivoting shafts 156 engage with teeth 154 to fix reward member 136 at a specific angle relative to forward member 134. When pivoting shafts 156 are compressed they disengage from teeth 154 and allow reward member 136 to freely rotate about forward member 134. In one embodiment the rotation amount is limited to 180 degrees. In an alternative embodiment, a wave spring is used to facilitate engagement and disengagement of pivoting shafts 156 from teeth 154. In another embodiment only a single pivoting shaft 156 and securing member 158 are used.

This configuration allows backshell 52 to be adjusted to form any existing desirable cable angle by engaging attachment mechanism 138 on the sides. Backshell 52 is adjustable to an angular position with respect to an attached connector such as connector shell 50 or socket connector shell 51 by pressing on front tangs 146 and rotating backshell 52 to achieve the desired angle. In one embodiment, backshell 52 does not require tools to adjust the angle during connector and cable installations. This feature allows easy placement and adjustment. Backshell 52 contains fewer loose parts compared to similar competitive products. Backshell 52 further provides a grounding path for an attached connector such as connector shell 50 or socket connector shell 51 for applications that require cable shield terminated to backshells (EMI shielding effectiveness). Various embodiments of backshell 52 in other connector platforms (e.g. rectangular and square connectors) are contemplated. Backshell 52 provides a compact and light weight solution when compared to existing designs.

Figure 29A:
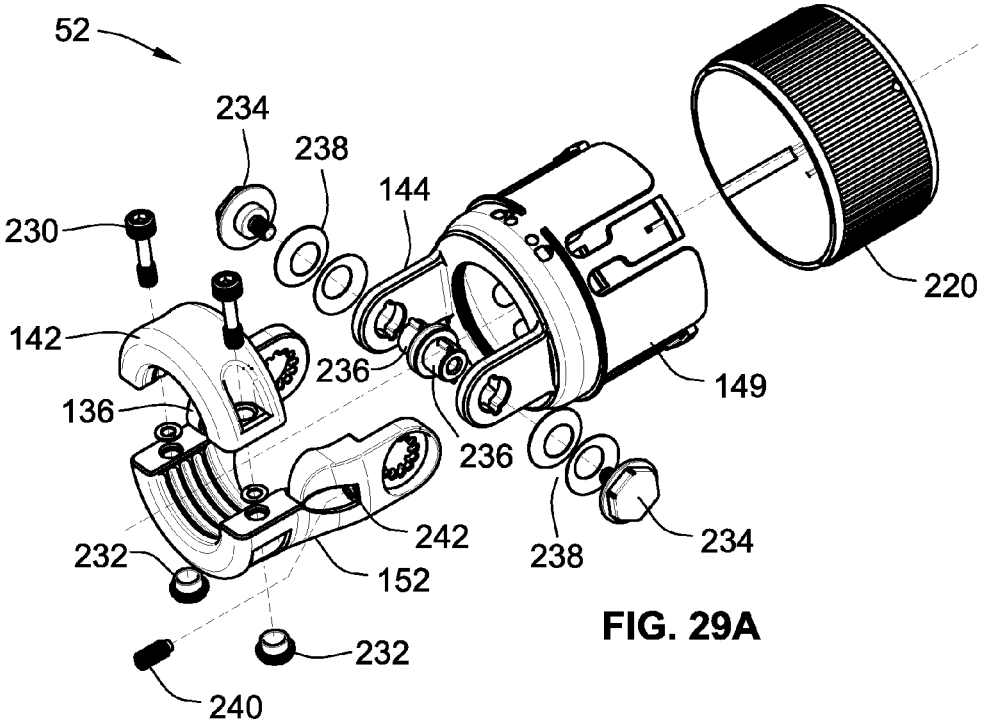
FIG. 29A is a perspective exploded view of an alternate embodiment of a backshell.
Figure 29B:
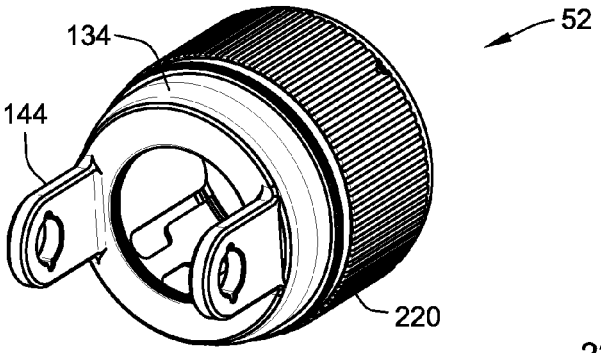
FIG. 29B is a rear perspective view of the backshell of FIG. 29A in a partially assembled configuration.
Figure 29C:
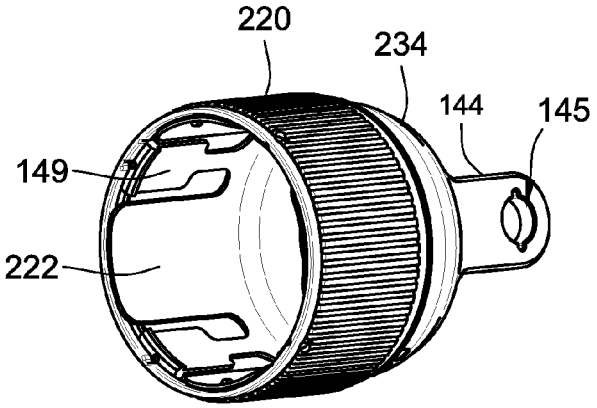
FIG. 29C is a front perspective view of the backshell of FIG. 29A in a partially assembled configuration.

Referring to FIGS. 29A-29C, another embodiment of a backshell connector 52 is shown. In the embodiment shown, forward structure 34 is provided with four tangs 149. In other embodiments, two, three, or five or more tangs may be provided. To simultaneously depress the multiple tangs 149 of forward structure 134, a rotatable shell 220 is fitted to the radially outward surface 222 of forward structure 134. Rotatable shell 220 may be rotated about the longitudinal axis of forward structure 143 between a first position and a second position, wherein tangs 149 are simultaneously depressed when rotatable shell 220 is in the first position, and wherein tangs 149 are not depressed when rotatable shell 220 is in the second position. Backshell 52 can be quickly disengaged from a connected connector by rotating rotatable shell 220 from the second position to the first position, thereby pressing all tangs 149 radially inward from radially outward surface 222.

Alternate features of rearward member 136 of backshell 52 are also shown in the embodiment of FIG. 29A. As shown, clamp 142 may be secured to rearward member 136 by bolts 230, shown as captive Allen-head bolts 230 and captive nuts 232. Additionally, second pivot structure 152 of rearward member 136 may be rotatably coupled to first pivot structure 144 of forward member 134 by bolt 234 and nut 236. One or more wave washers 238 may be provided to tension nut and bolt 234, 236 and prevent vibrational disengagement of rearward member 136 from forward member 134. A pin 240, shown as a set screw 240, optionally engages first pivot structure 144 through threaded opening 242 to releasably secure second pivot structure 152 of rearward member 136 in a fixed rotational position with respect to first pivot structure 144 of forward member 134.

Referring to FIGS. 29B and 29C, views of rotatable shell 220 assembled with forward member 134 of backshell 52 are shown. Components of rearward member 136 are omitted. An optical indicator may be optionally provided on radially outward surface 222 to indicate whether rotatable shell 222 is in the first position or the second position. For example, a hole in rotatable shell 222 may show a red dot when rotatable shell is in the first position.

Figure 30:
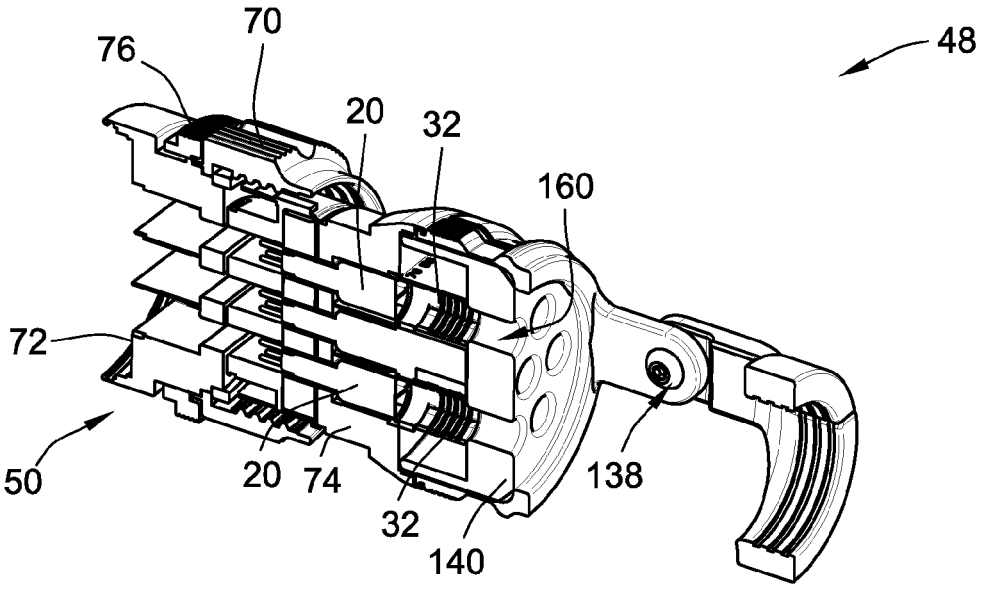
FIG. 30 is a cross-sectional view of the backshell of FIG. 28 and FIG. 29.

Referring now to FIG. 30 a cross-sectional view of housing 48 having backshell 52, connector shell 50, and modules 20 is shown. Backshell 52 is coupled to bottom insert 74 such that channels 160 align with cavities 32 of modules 20 contained within connector shell 50. Seal grommet 140 can have multiple internal rings in each channel 160 to effectively accommodate any irregular cable surface.

It should be understood that the figures illustrate the exemplary embodiments in detail, and it should be understood that the present application is not limited to the details or methodology set forth in the description or illustrated in the figures. It should also be understood that the terminology is for the purpose of description only and should not be regarded as limiting.

For purposes of this disclosure, the term "coupled" means the joining of two components directly or indirectly to one another. Such joining may be stationary in nature or movable in nature. Such joining may be achieved with the two members and any additional intermediate members being integrally formed as a single unitary body with one another or with the two members or the two members and any additional member being attached to one another. Such joining may be permanent in nature or alternatively may be removable or releasable in nature.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A decoupling resistive connector shell comprising:

a coupling nut having a first engagement structure and a second engagement structure;

a top insert coupled to the coupling nut and a first annular opening;

a bottom insert coupled to the top insert having first anti-rotation engagement portion and a second annular opening aligned with the first annular opening; and an anti-decoupling ring disposed around a portion of the top and bottom inserts and moveable between a first position and a second position, wherein the anti-decoupling ring is engaged with the second engagement structure of the coupling nut when in the first position and disengaged from the second engagement structure of the coupling nut when in the second position, and a second anti-rotation engagement portion engaged with the first anti-rotation engagement portion to thereby resist rotation of the anti-decoupling ring around the top and bottom inserts, and in turn prevent rotation of the coupling nut through engagement with the second engagement structure when the anti-decoupling ring is in the first position.

2. The decoupling resistive connector shell of claim 1, wherein the first anti-rotation engagement portion is a notch and the second anti-rotation engagement portion is a flange, wherein the flange is received by the notch.

3. The decoupling resistive connector shell of claim 1, further comprising at least one spring positioned between the anti-decoupling ring and the bottom insert to bias the anti-decoupling ring to the first position.

4. The decoupling resistive connector shell of claim 1, wherein the first engagement structure is a threaded portion.

5. A multiple axis backshell for tool-less reconfiguration comprising:

a forward member having an engagement structure for selectively coupling the backshell to a connector shell and a first pivot structure;

a rearward member having an annular opening for receiving a plurality of cables and a second pivot structure; and an engageable attachment mechanism coupling the first pivot to the second pivot such that when the attachment mechanism is engaged the reward member can freely rotate around the forward member and when the attachment mechanism is disengaged the reward member is fixed at a specific angle relative to the forward member.

6. The multiple axis backshell of claim 5, further comprising a set screw moveable between a first position and a second position, wherein the set screw allows rotation of the rearward member around the forward member when in the first position, inhibits rotation of the rearward member around the forward member when in the second position.

7. The multiple axis backshell of claim 5 wherein the reward member can rotate up to 180 degrees around the forward member when the attachment mechanism is engaged.

8. The multiple axis backshell of claim 5 wherein the reward member can rotate up to 180 degrees around the forward member when the attachment mechanism is engaged.

9. A connector shell comprising:

a first connector module sized to contain a plurality of cables, the first connector module providing a separate electrically conductive path for individual wires contained within the first plurality of cables;

a second connector module sized to contain a second plurality of cables, the second connector providing a separate electrically conductive path for individual wires contained within the second plurality of cables; and a housing having conduits sized and shaped to contain the first and second connector modules, the housing providing a grounding path for noise and interference form the first and second connector modules.

10. A connector comprising:

a connector shell comprising:

a coupling nut having a first engagement structure and a second engagement structure;

a top insert coupled to the coupling nut and having a first conduit;

a bottom insert coupled to the top insert having a second conduit aligned with the first conduit; and an anti-decoupling ring disposed around a portion of the top and bottom inserts and slideably moveable between a first position and a second position, wherein the anti-decoupling ring is engaged with the second engagement structure of the coupling nut when in the first position and disengaged from the second engagement structure of the coupling nut when in the second position;

an electrically conductive isolator including a first cavity configured to receive a cable containing a plurality of twisted pairs of wires and a forward section having a plurality of channels, each channel having at least one horizontal wall and at least one vertical wall, each channel configured to receive a twisted pair of the plurality of twisted pairs, and a junction between the first cavity and the forward section, a first insulating member having a plurality of indentations and coupled to at least a portion of the horizontal and vertical walls of the channels;

a plurality of electrical contacts situated in the indentations of the first insulating member and electrically coupled to an end of each wire in each twisted pair of the plurality of twisted pairs;

a second insulating member surrounding the first insulating member and the conductors, wherein the electrically conductive isolator, first insulating member, plurality of electrical contacts, and second insulating member are positioned within the first conduit and second conduit of the connector shell.

11. The connector module of claim 10, wherein a bottom bracket is removably coupled to the junction, and wherein the bottom bracket comprises the first cavity.

12. The connector module of claim 10, further comprising a multiple axis backshell.

* * * * *